US009486847B2

(12) United States Patent
Kobayashi et al.

(10) Patent No.: US 9,486,847 B2
(45) Date of Patent: Nov. 8, 2016

(54) COOLING APPARATUS, AND MANUFACTURING APPARATUS AND MANUFACTURING METHOD OF HOT-ROLLED STEEL SHEET

(75) Inventors: Kazuaki Kobayashi, Kashima (JP); Tomofumi Hosho, Kashima (JP); Keisuke Matsuda, Kashima (JP); Yoichi Haraguchi, Sakura (JP); Yuji Ikemoto, Hiroshima (JP); Kenji Horii, Hiroshima (JP)

(73) Assignees: NIPPON STEEL & SUMITOMO METAL CORPORATION, Tokyo (JP); PRIMETALS TECHNOLOGIES JAPAN, LTD., Tokyo (JP)

( * ) Notice: Subject to any disclaimer, the term of this patent is extended or adjusted under 35 U.S.C. 154(b) by 478 days.

(21) Appl. No.: 14/131,028

(22) PCT Filed: Jul. 20, 2012

(86) PCT No.: PCT/JP2012/068438

§ 371 (c)(1),
(2), (4) Date: Jan. 6, 2014

(87) PCT Pub. No.: WO2013/012060

PCT Pub. Date: Jan. 24, 2013

(65) Prior Publication Data

US 2014/0138054 A1 May 22, 2014

(30) Foreign Application Priority Data

Jul. 21, 2011 (JP) ..... 2011-159943

(51) Int. Cl.
*C21D 1/667* (2006.01)
*B21B 45/02* (2006.01)

(Continued)

(52) U.S. Cl.
CPC ..... *B21B 45/0218* (2013.01); *B21B 37/76* (2013.01); *B21B 45/0233* (2013.01); *B21C 51/00* (2013.01); *C21D 1/62* (2013.01)

(58) Field of Classification Search
CPC ..... B21B 45/0218; B21B 45/0233; B21B 37/76; B21C 51/00; C21D 1/62; C21D 8/0226
USPC ..... 266/44, 46, 113, 114; 72/16.2
See application file for complete search history.

(56) References Cited

U.S. PATENT DOCUMENTS 8,394,318 B2 * 3/2013 Kobayashi ..... B21B 45/0218 266/113
8,440,133 B2 * 5/2013 Eto ..... B21B 45/0218 266/113

(Continued)

FOREIGN PATENT DOCUMENTS

JP 3770216 4/2006
JP 4029871 1/2008

(Continued)

*Primary Examiner* — David B Jones
(74) *Attorney, Agent, or Firm* — Clark & Brody

(57) ABSTRACT

Provided is a cooling apparatus discharging water smoothly corresponding to increase of volume density of cooling water securing a high cooling capability. The apparatus disposed on downstream side from a row of hot finish rolling mill, supplying cooling water from above toward a pass line, includes a plurality of cooling nozzles arranged parallel in a pass line direction, and an upper surface guide disposed between the pass line and the cooling nozzles, wherein a predetermined relation is satisfied when defining: a volume density of cooling water sprayed as $q_m(m^3/(m^2 \cdot sec))$; a pitch of the cooling nozzle in the pass line direction as L(m); a distance between a lower surface of the upper surface guide and the pass line as $h_p(m)$; a uniform cooling width as $W_u(m)$; and a cross-sectional area of virtual flow path of discharging water flowing in a width direction of steel sheet as $S(m^2)$.

8 Claims, 9 Drawing Sheets

(51) Int. Cl.

| | |
|---|---|
| ***B21C 51/00*** | (2006.01) |
| ***B21B 37/76*** | (2006.01) |
| ***C21D 1/62*** | (2006.01) |

(56) References Cited

U.S. PATENT DOCUMENTS

| | | | | |
|---|---|---|---|---|
| 9,180,506 | B2 * | 11/2015 | Januszkiewicz | B21B 37/74 |
| 9,308,563 | B2 * | 4/2016 | Ota | B21B 37/76 |
| 2008/0087066 | A1 * | 4/2008 | Takahama | B21B 1/28 72/45 |
| 2014/0138054 | A1 * | 5/2014 | Kobayashi | B21B 45/0233 165/104.19 |
| 2014/0250963 | A1 * | 9/2014 | Nelson | B21B 37/44 72/12.7 |
| 2014/0260476 | A1 * | 9/2014 | Januszkiewicz | B21B 45/0251 72/45 |

FOREIGN PATENT DOCUMENTS

| | | |
|---|---|---|
| JP | 2011-011217 | 1/2011 |
| JP | 2011-020146 | 2/2011 |

* cited by examiner

COOLING APPARATUS, AND MANUFACTURING APPARATUS AND MANUFACTURING METHOD OF HOT-ROLLED STEEL SHEET

TECHNICAL FIELD

The present invention relates to a cooling apparatus, and a manufacturing apparatus and a manufacturing method of a hot-rolled steel sheet. More particularly, it relates to a cooling apparatus that is excellent in discharging cooling water and able to secure a high cooling capability, and a manufacturing apparatus and manufacturing method of a hot-rolled steel sheet.

BACKGROUND ART

A steel material used for automobiles, structural materials, and the like is required to be excellent in such mechanical properties as strength, workability, and toughness. In order to improve these properties comprehensively, it is effective to make a steel material with a fine-grained structure; to this end, a number of manufacturing methods to obtain a steel material with a fine-grained structure have been sought. Further, by making the fine-grained structure, it is possible to manufacture a high-strength hot-rolled steel sheet having excellent mechanical properties even if the amount of alloy elements added is reduced.

As a method for making a steel sheet with a fine-grained structure, it is known to carry out a large rolling reduction especially in the subsequent stage of hot finish rolling (in any rolling mill to roll a steel sheet on downstream side when a plurality of rolling mills are aligned in parallel), deforming austenite grains greatly and increasing a dislocation density; and thereby to obtain fine-grained ferrite after rolling. Further, in view of facilitating the ferrite transformation by inhibiting recrystallization and recovery of the austenite grains, it is effective to cool a steel sheet to 600° C. to 750° C. as quickly as possible after rolling. In other words, subsequent to hot finishing rolling, it is effective to rapidly cool a steel sheet after the rolling, by arranging a cooling apparatus capable of cooling more quickly than ever before. In rapidly cooling a steel sheet after rolling in this way, it is effective to have a large volume of cooling water sprayed over the steel sheet per unit area, and to make a volume density of cooling water (sometimes referred to as "cooling water volume density") large in order to enhance a cooling capability.

However, if the cooling water volume density is increased in this way, the water accumulated (i.e. retained water) on an upper surface of a steel sheet increases due to a relation between water supply and water discharge. By the increase of the retained water, the retained water reaches an upper surface guide disposed between the steel sheet and a cooling nozzle and having a hole that allows cooling water sprayed from the cooling nozzle to pass through, whereby so-called overflow can occur. The overflow sometimes causes troubles as follows.

(1) By making a thick layer of the retained water, jet pressure of the cooling water sprayed from the cooling nozzle decays. If the layer of the retained water becomes even thicker and reaches the cooling nozzle, the jet pressure decays more.

(2) In discharging the retained water, the retained water has contact with the upper surface guide and creates a flow resistance, whereby discharging capability degrades.

(3) Since it is difficult to control overflowed water, the water can flow into other areas and so on, which can cause unexpected problems.

Therefore, because of such troubles as above, there is a problem that high cooling capability cannot be exerted, and sometimes it is difficult to effectively have cooling water with a large volume density to spray to a steel sheet.

With regard to discharging water on an upper surface side of a steel sheet, techniques such as Patent Document 1 and 2 have been disclosed. In a cooling apparatus of a hot-rolled steel strip described in Patent Document 1, a hole is provided to an upper surface guide configured to supply cooling water by allowing the cooling water to pass through, and to overflow retained water. Also, in a cooling apparatus of a steel sheet described in Patent Document 2, a hole to supply cooling water to an upper surface guide and a slit to handle overflow are provided separately to allow retained water to discharge smoothly thereto inhibit degradation of cooling capability.

CITATION LIST

Patent Literature

Patent Document 1: Japanese Patent No. 3770216
Patent Document 2: Japanese Patent No. 4029871

SUMMARY OF THE INVENTION

Problems to be Solved by the Invention

However, the cooling apparatus having a configuration of the upper surface guide described above is based on the premise that overflow occurs, in other words, the retained water reaches the upper surface guide. Considering increasing of water volume density and volume of cooling water to supply thereby improving cooling capability, another technique to improve water discharging capability needs to be provided.

If the upper surface guide is disposed at a high position, possibility of the overflow can be reduced. However, in order to avoid breaking of the cooling nozzle by having contact with a steel sheet, the upper surface guide needs to be disposed at a lower position than a position of a water ejection outlet of the cooling nozzle. Also, the cooling nozzle is desired to be provided as close (as low) to the steel sheet as possible in order to inhibit degradation of the cooling capability. Therefore, it is preferable that the upper surface guide is also disposed as low as possible.

Accordingly, considering the above problems, an object of the present invention is to provide: a cooling apparatus of a steel sheet capable of discharging water adequately corresponding to increase of volume density of cooling water, to thereby secure a high cooling capability; and a manufacturing apparatus and manufacturing method of a hot-rolling steel sheet using the cooling apparatus.

Means for Solving the Problems

The present invention will be described below.

A first aspect of the present invention is a cooling apparatus disposed on a downstream side from a row of hot finish rolling mills, capable of supplying cooling water from above a pass line toward the pass line, comprising: a plurality of cooling nozzles aligned in parallel in a direction of the pass line; and an upper surface guide to be disposed between the pass line and the cooling nozzles, wherein each cooling nozzle of the plurality of cooling nozzles can spray cooling water with a cooling water volume density of 0.16 ($m^3/(m^2 \cdot sec)$) or more, and when the cooling water volume density to be sprayed is defined as $q_m$ ($m^3/(m^2 \cdot sec)$), a pitch of the cooling nozzle in a pass line direction is defined as L (m), a distance between a lower surface of the upper surface guide and the pass line is defined as $h_p$ (m), a uniform cooling width is defined as $W_u$ (m), and a cross-sectional area of virtual flow path of discharging water flowing in a width direction of a steel sheet per pitch of the cooling nozzle in the pass line direction is defined as S ($m^2$), the following relation is satisfied.

$$0.08 \cdot \frac{q_m \cdot W_u \cdot L}{S \cdot \sqrt{h_p}} \leqq 1$$

A second aspect of the present invention is the cooling apparatus according to the first aspect, wherein the upper surface guide has a configuration in which a distance between the pass line and the upper surface guide changes in the pass line direction, and a corresponding height $h_p'$ of the upper surface guide is applied instead of $h_p$.

A third aspect of the present invention is the cooling apparatus according to the first or second aspect, wherein at least either one of the upper surface guide or the cooling nozzle can move in top and bottom direction.

A fourth aspect of the present invention is a manufacturing apparatus of a hot-rolled steel sheet comprising: a row of hot finish rolling mills; and the cooling apparatus according to any one of the first to third aspects disposed on a downstream side from the row of hot finish rolling mills, wherein an end portion on upstream side of the cooling apparatus is disposed inside a final stand in the row of hot finish rolling mills.

A fifth aspect of the present invention is a manufacturing method of a hot-rolled steel sheet comprising a step to supply cooling water to at least an upper surface of a steel sheet after final rolling to cool the steel sheet by a cooling apparatus disposed to a downstream side from a row of hot finish rolling mills, wherein following relation is satisfied when a volume density of cooling water from a cooling nozzle provided to the cooling apparatus is defined as $q_a$ ($m^3/(m^2 \cdot sec)$) that is 0.16 ($m^3/(m^2 \cdot sec)$) or more, a pitch of the cooling nozzle in a sheet passing direction is defined as L (m), a distance between a lower surface of an upper surface guide disposed to the cooling apparatus and an upper surface of the steel sheet to be passed is defined as $h_a$ (m), a width of the steel sheet to be passed is defined as $W_a$ (m), and a cross-sectional area of virtual flow path of discharging water flowing in a width direction of the steel sheet per pitch of the cooling nozzle in the sheet passing direction is defined as $S_a$ ($m^2$).

$$0.08 \cdot \frac{q_a \cdot W_a \cdot L}{S_a \cdot \sqrt{h_a}} \leqq 1$$

A sixth aspect of the present invention is the manufacturing method of a hot-rolled steel sheet according to the fifth aspect, wherein a corresponding height $h_a'$ of the upper surface guide is applied instead of $h_a$ when the upper surface guide has a configuration in which a distance between the steel sheet and the upper surface guide changes in the sheet passing direction.

A seventh aspect of the present invention is the manufacturing method of a hot-rolled steel sheet according to the fifth or sixth aspect, wherein at least either one of the upper surface guide or the cooling nozzle can move in top and bottom direction.

An eighth aspect of the invention is the manufacturing method of a hot-rolled steel sheet according to any one of the fifth to seventh aspects, wherein an end portion on upstream side of the cooling apparatus is disposed inside a final stand in the row of hot finish rolling mills.

Effect of the Invention

By the present invention, it is possible to provide a cooling apparatus capable of: providing a large amount of cooling water with a high volume density thereto cool a steel sheet; and discharging the water smoothly, thereby enabling manufacturing a hot-rolled steel sheet with a fine-grained structure. In other words, as a result of discharging water smoothly, it is possible to prevent an upper side of retained water from reaching the upper surface guide, thereby enabling cooling the steel sheet effectively. Further, smooth discharging water like this inhibits cooling non-uniformity in the width direction of the steel sheet, thereby enabling cooling more uniformly.

MODES FOR CARRYING OUT THE INVENTION

The functions and benefits of the present invention described above will be apparent from the following modes for carrying out the invention. The present invention will be described based on the embodiments shown in the accompanying drawings. However, the invention in not limited to these embodiments.

Figure 1:
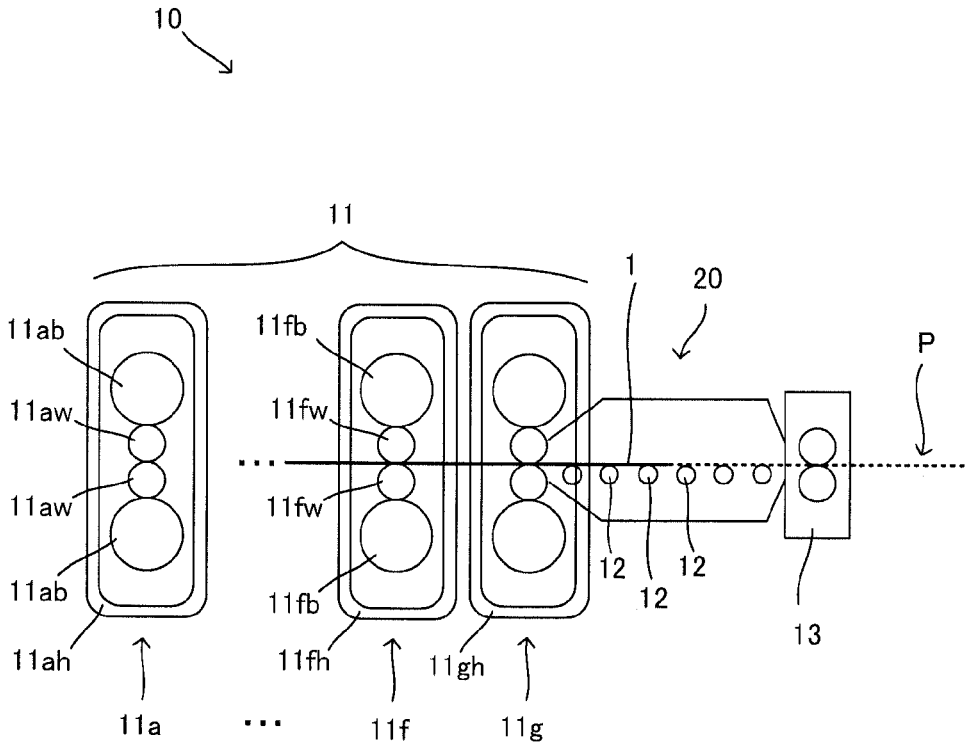
FIG. 1 is a schematic view showing a part of a manufacturing apparatus of a hot-rolled steel sheet that comprises a cooling apparatus according to one embodiment.

FIG. 1 is a schematic view showing a part of a manufacturing apparatus 10 of a hot-rolled steel sheet including a cooling apparatus 20 (hereinafter, sometimes referred to as "cooling apparatus 20") according to one embodiment. In FIG. 1, a steel sheet 1 is transported from left on the sheet of paper (upstream side, upper process side) to right (downstream side, lower process side), a direction from top to bottom on the sheet of paper being vertical direction. A direction from the upstream side (the upper process side) to the downstream side (the lower process side) may be referred to as a sheet passing direction. Further, a direction of a width of the steel sheet to be passed, which is orthogonal to the sheet passing direction may be referred to as a width direction of steel sheet. Hereinafter, reference symbols may be omitted in the below descriptions of the drawings for the purpose of easy viewing. In view of FIG. 1, a line that a steady rolling part (a part except for a top portion and a bottom portion) of the steel sheet 1 passes through is shown as a pass line P. Therefore, the steady rolling part of the steel sheet passes the pass line P.

As shown in FIG. 1, the manufacturing apparatus 10 of a hot-rolled steel sheet comprises: a row of hot finish rolling mills 11; the cooling apparatus 20; transporting rolls 12, 12, . . . ; and a pinch roll 13. Further, a heating furnace, a row of rough rolling mills, and the like, the figures and descriptions thereof are omitted, are disposed on an upstream side from the row of hot finish rolling mills 11. These set better conditions for a steel sheet to go through the row of hot finish rolling mills 11. On the other hand, another cooling apparatus or various kinds of equipment such as a coiler to ship the steel sheet as a steel sheet coil, are disposed on a downstream side from the pinch roll 13.

A hot-rolled steel sheet is generally manufactured in the following way. A rough bar which has been taken from a heating furnace and has been rolled by a rough rolling mill to have a predetermined thickness is rolled continuously by the row of hot finish rolling mills 11 to have a predetermined thickness, while a temperature thereof is controlled. After that, the steel sheet is rapidly cooled in the cooling apparatus 20. Here, the cooling apparatus 20 is disposed inside a housing 11*gh* that supports rolls (work rolls) in a final stand 11*g* of the row of hot finish rolling mills 11, in a manner as closely to the rolls 11*gw*, 11*gw* (see FIG. 2) of the final stand 11*g* as possible. Then, the steel sheet passes through the pinch roll 13, and is cooled by another cooling apparatus to a predetermined coiling temperature to be coiled by a coiler.

Figure 2A:
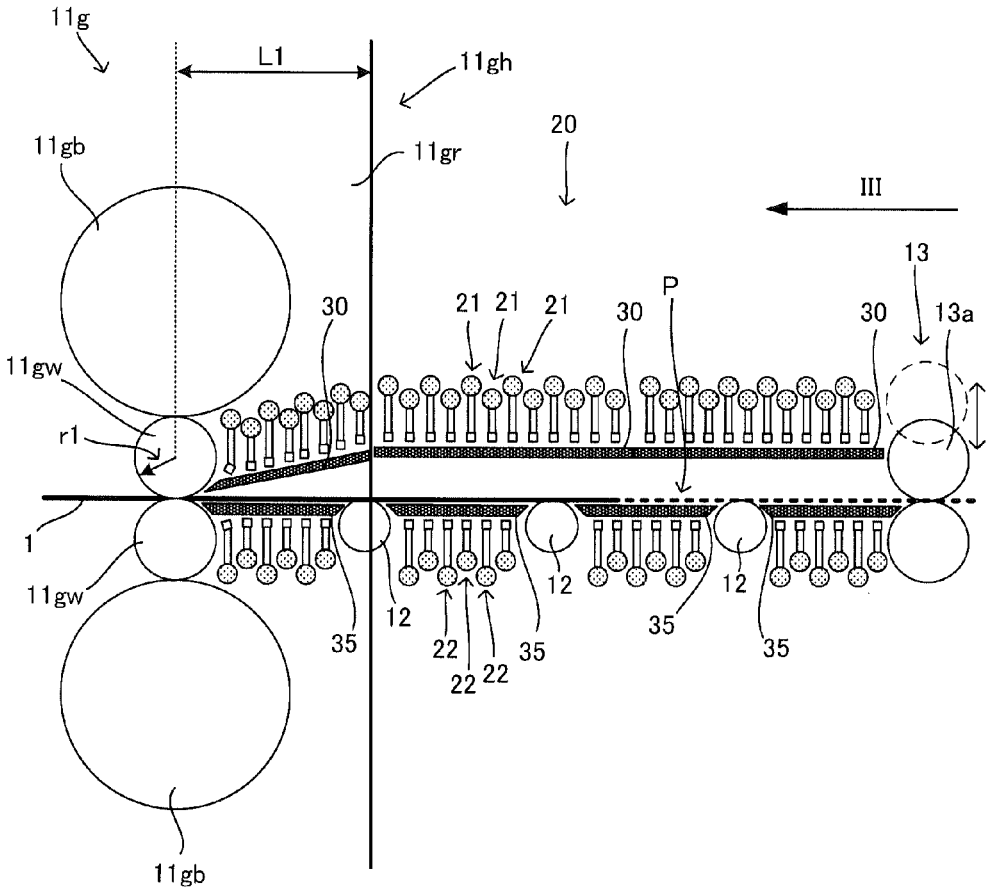
FIG. 2A is an enlarged view of an area in FIG. 1, where the cooling apparatus is disposed, showing the cooling apparatus in its entirety.
Figure 2B:
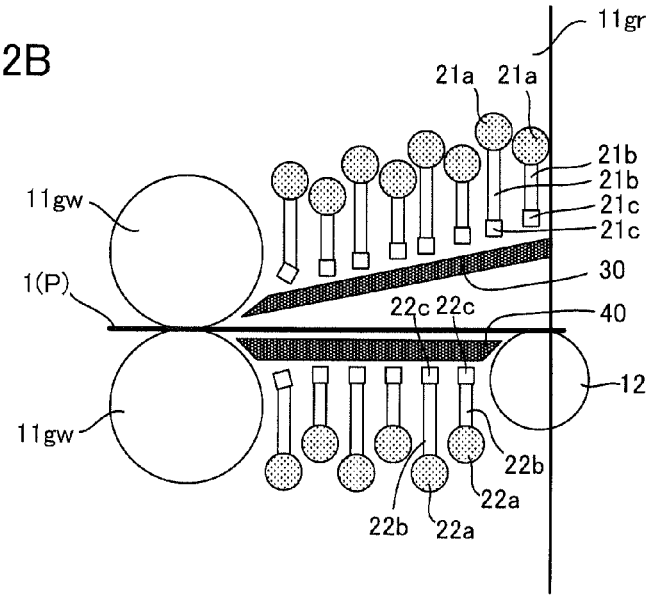
FIG. 2B is a view further focusing on an upstream side of the FIG. 2A.
Figure 3:
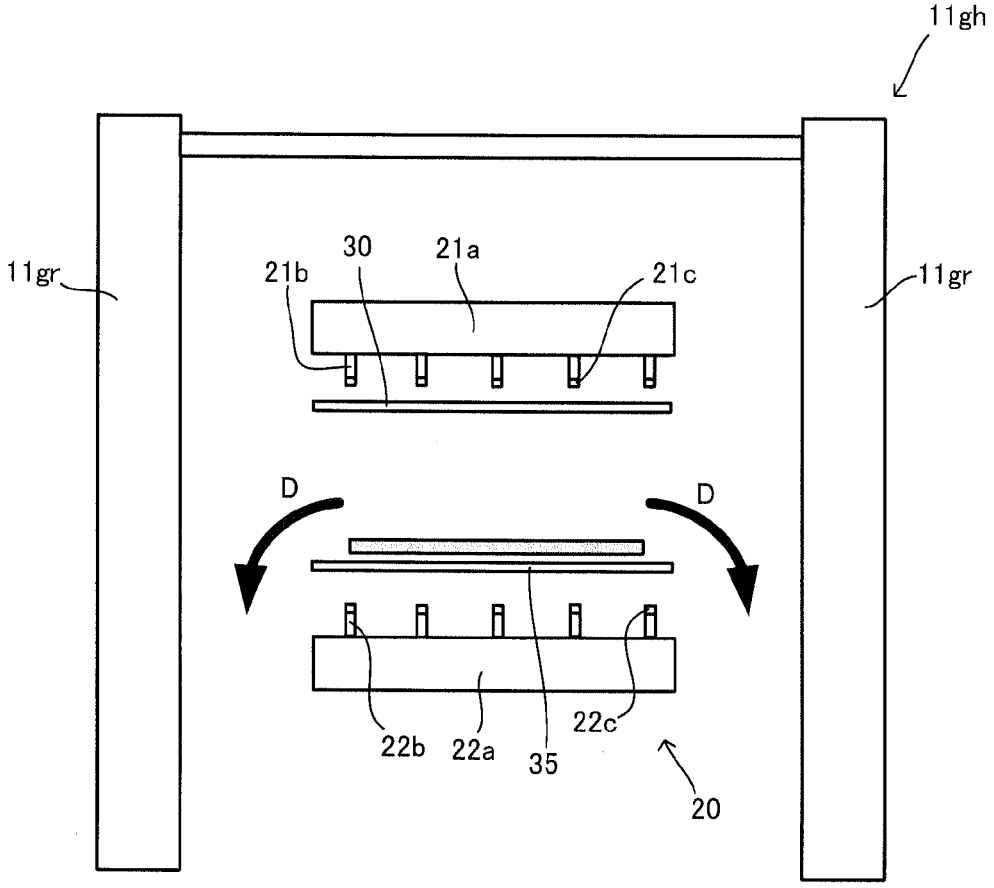
FIG. 3 is a view seen from an arrow III in FIG. 2A

Hereinafter, the manufacturing apparatus 10 of a hot-rolled steel sheet (hereinafter sometimes referred to as "manufacturing apparatus 10"), including the cooling apparatus 20, will be described. FIG. 2 is an enlarged view of an area in FIG. 1, where the cooling apparatus 20 is provided. FIG. 2A is an enlarged view showing the cooling apparatus in entirety, whereas FIG. 2B is a view further focusing on the vicinity of the final stand 11*g*. FIG. 3 is a schematic view of the manufacturing apparatus 10 seen from a downstream side of the final stand 11*g*, from a direction shown by an arrow III in FIG. 2A. Therefore, in FIG. 3, a direction from top to bottom on the sheet of paper is vertical direction of the manufacturing apparatus 10, a direction from left to right on the sheet of paper is the width direction of steel sheet, and a direction from back to front is the sheet passing direction.

In the row of hot finish rolling mills 11 in the embodiment, seven stands (11*a*, 11*b*, . . . , 11*g*) are aligned along the sheet passing direction as can be seen from FIG. 1. Each of the stands 11*a*, 11*b*, . . . , 11*g* includes a rolling mill, and a rolling reduction and the like are set in each rolling mill to allow a steel sheet to meet conditions for thickness, mechanical properties, surface quality, and the like which are required as a final product. Here, the rolling reduction of each of the stands 11*a*, 11*b*, . . . , 11*g* is set in a manner that the steel sheet to be manufactured satisfies the required properties. However, in view of carrying out a large rolling reduction to deform austenite grains greatly and to increase a dislocation density, thereby obtaining a steel sheet having a fine-grained ferrite after rolling, the rolling reduction is preferably large at the final stand 11*g*. The rolling mill of each stand of 11*a*, . . . , 11*f*, 11*g* has a pair of work rolls 11*aw*, 11*aw*, . . . , 11*fw*, 11*fw*, 11*gw*, 11*gw* to roll actually sandwiching the steel sheet, and a pair of backup rolls 11*ab*, 11*ab*, . . . , 11*fb*, 11*fb*, 11*gb*, 11*gb* disposed in a manner that an outer periphery thereof has contact with an outer periphery of the work rolls 11*aw*, . . . , 11*aw*, 11*fw*, 11*fw*, 11*gw*, 11*gw*. Also, the rolling mill includes the work rolls 11*aw*, 11*aw*, . . . , 11*fw*, 11*fw*, 11*gw*, 11*gw*, the backup rolls 11*ab*, 11*ab*, . . . , 11*fb*, 11*fb*, 11*gb*, 11*gb* thereinside, and housings 11*ah*, . . . , 11*fh*, 11*gh* each forming an outer shell of each of the stands 11*a*, . . . , 11*f*, 11*g* that support the work rolls 11*aw*, 11*aw*, . . . , 11*fw*, 11*fw*, 11*gw*, 11*gw* and the backup rolls 11*ab*, 11*ab*, . . . , 11*fb*, 11*fb*, 11*gb*, 11*gb*. Each of the housings 11*ah*, . . . , 11*fh*, 11*gh* has a standing portion vertically disposed facing to the housings 11*ah*, . . . , 11*fh*, 11*gh* (for example, in the final stand 11*g*, the standing portion 11*gr*, 11*gr* shown in FIG. 3). That is, as can be seen from FIG. 3, the standing portion of the housing is disposed in a manner to sandwich the steel sheet 1 (pass line P) in the width direction of steel sheet. Also, the standing portions 11*gr*, 11*gr* of the final stand 11*g* are vertically disposed in a manner to sandwich a part of the cooling apparatus 20 and the steel sheet 1 (pass line P) in the width direction of the steel sheet.

Here, a distance between the shaft center of the work roll 11*gw* and an end surface on downstream side of the standing portions 11*gr*, 11*gr* of the housing, which is shown by L1 in FIG. 2A is preferably larger than a radius r1 of the work roll 11*gw*. This makes it possible to dispose a part of the cooling apparatus 20 in a portion corresponding to L1-r1 as mentioned below. In other words, it is possible to dispose a part of the cooling apparatus 20 in a manner to insert it inside the housing 11*gh*. Also, as shown in FIG. 3, in the portion in which the cooling apparatus 20 is inserted between the standing portions 11*gr*, 11*gr* of the housing, the standing portions 11*gr*, 11*gr* of the housing exist as side walls in both sides of the cooling apparatus 20 in the width direction of steel sheet. And a predetermined space is formed between the end portions of the cooling apparatus 20 in the width direction of steel sheet and the standing portions 11*gr*, 11*gr* of the housing.

Next, the cooling apparatus 20 will be described. The cooling apparatus 20 comprises: upper surface water supplying devices 21, 21, . . . ; lower surface water supplying devices 22, 22, . . . ; upper surface guides 30, 30, . . . ; and lower surface guides 35, 35, . . . .

The upper surface water supplying devices 21, 21, . . . are devices to supply cooling water from above to an upper surface side of the steel sheet 1, which is the pass line P. The upper surface water supplying devices 21, 21, . . . comprise: cooling headers 21*a*, 21*a*, . . . ; conduits 21*b*, 21*b*, . . . , respectively provided to the cooling headers 21*a*, 21*a*, . . . , in a form of a plurality of rows; and cooling nozzles 21*c*, 21*c*, . . . respectively attached to end portions of the conduits 21*b*, 21*b*, . . . . In the embodiment, each cooling header 21*a* is a pipe extending in the width direction of the steel sheet as can be seen from the FIGS. 2 and 3, and the cooling headers 21*a*, 21*a*, . . . are aligned in the sheet passing direction. Each conduit 21*b* is a thin pipe diverging from each cooling header 21*a* in a plural form, and an opening end of the conduit is directed toward the upper surface side of the steel sheet (the pass line 2). A plurality of the conduits 21*b*, 21*b*, . . . are arranged in a comb-like manner along a direction of a tube length of the cooling header 21*a*, namely, in the width direction of the steel sheet.

Figure 4:
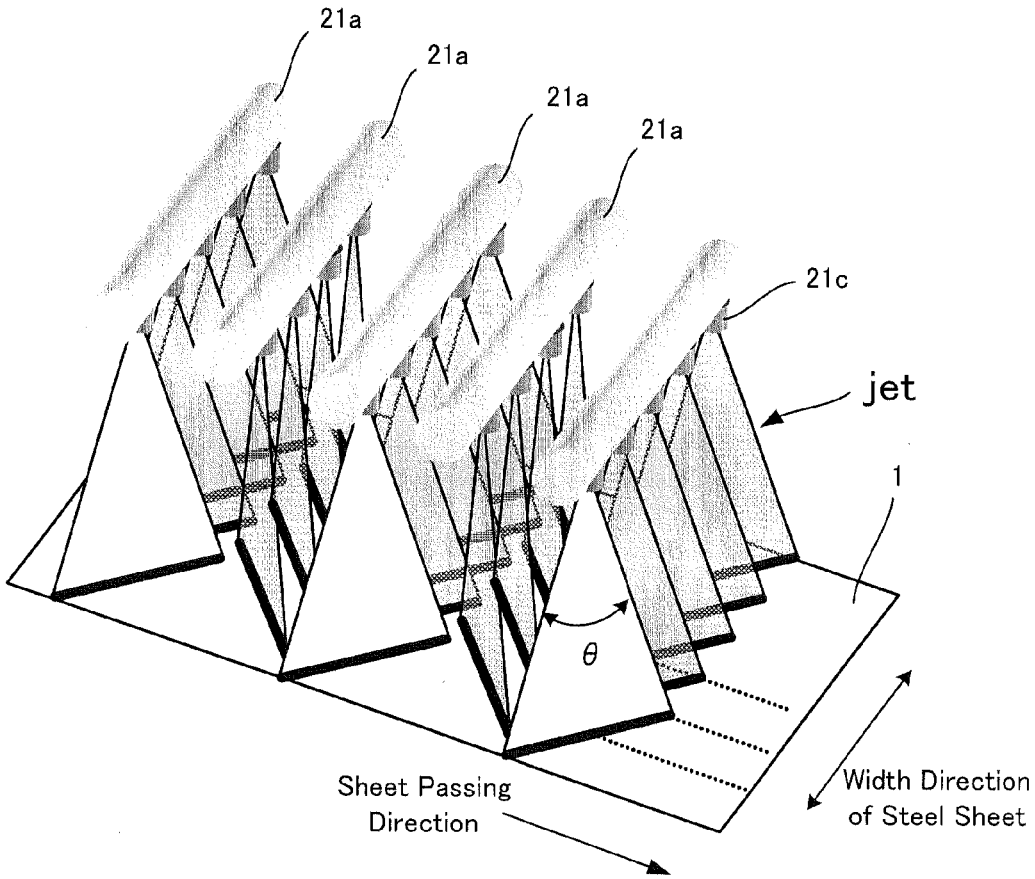
FIG. 4 is a view to describe a cooling nozzle.
Figure 5:
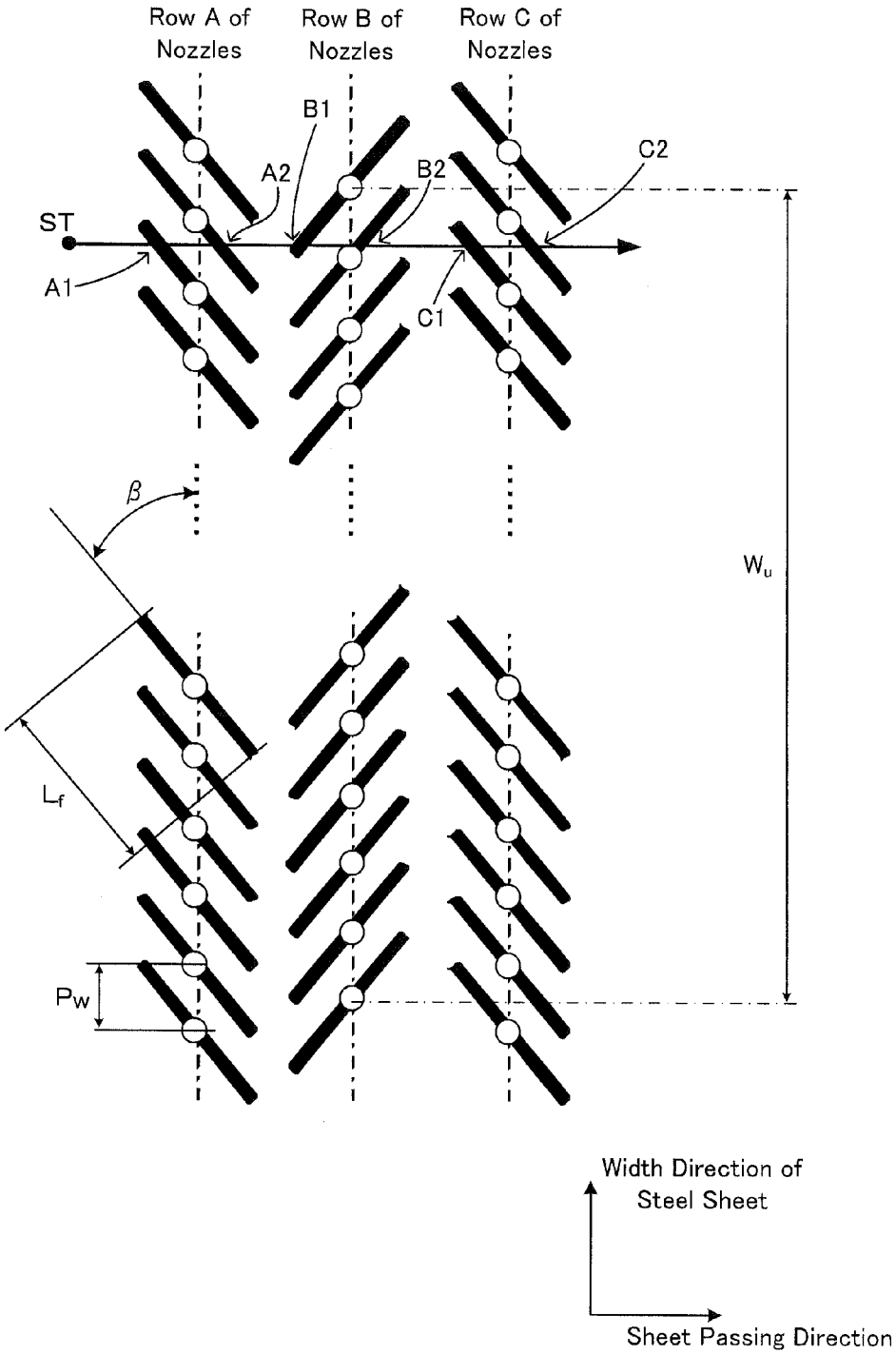
FIG. 5 is another view to describe the cooling nozzle.

An end portion of each of the conduits 21*b*, 21*b*, . . . is provided with each of the cooling nozzles 21*c*, 21*c*, . . . . The cooling nozzles 21*c*, 21*c*, . . . according to the embodiment are flat spray nozzles each can form a fan-like jet of cooling water (with a thickness of approximately 5 mm to 30 mm for example). FIGS. 4 and 5 schematically show the jets of cooling water formed on a surface of the steel sheet. FIG. 4 is a perspective view. In FIGS. 4 and 5, the sheet passing direction and the width direction of steel sheet are shown together. FIG. 5 schematically shows a manner of an impact by the jets of cooling water formed on the surface of the steel sheet. In FIG. 5, open circles show positions right below the cooling nozzles 21*c*, 21*c*, . . . . Further, thick lines schematically show impact positions and shape of the jets of cooling water. In FIG. 5, " . . . . . " means an omitted description. As can be seen from FIG. 5, a low of nozzles (for example, a row A of nozzles, a row B of nozzles, and a row C of nozzles) is formed by the cooling nozzles 21*c*, 21*c*, . . . arranged to one cooling header 21*a* of the cooling headers. Also, as can be seen from FIGS. 4 and 5, in the embodiment, the rows of nozzles next to each other (for example, the row A of nozzles and the row B of nozzles, and the row B of nozzles and the row C of nozzles) are arranged in a manner that the position of one of the rows in the width direction of the steel sheet differs from the position of its adjacent row. Further, the rows of nozzles are arranged in a so-called zigzag manner so that the position of the rows is the same as the position of the row that is located further next, in the sheet passing direction of steel sheet.

In the embodiment, the cooling nozzles are arranged so that an entire position on the surface of the steel sheet 1 in the width direction of steel sheet can pass through the jets of cooling water at least twice. That is, a point ST located on the passing steel sheet 1 moves along a linear arrow in FIG. 5. At this time, in such a manner as twice in the row A of nozzles (A1, A2); twice in the row B of nozzles (B1, B2); and twice in the row C of nozzles (C1, C2), the jets of water from the cooling nozzles belonging to any one of the rows strike twice. As such, the cooling nozzles 21*c*, 21*c*, . . . are arranged in a manner that the following relation is satisfied among a interval $P_W$ between the cooling nozzles 21*c*, 21*c*, . . . ; an impact width $L_f$ of the jets of cooling water; and a twisting angle β.

$$L_f = 2P_w/\cos\beta$$

Herein, the number of times at which the steel sheet passes through the jets of cooling water is set to be twice, to which the number of time is not limited; it may be three or more times. For a purpose of uniforming a cooling capability in the width direction of the steel sheet, in the rows of nozzles adjacent to each other in the sheet passing direction, the cooling nozzles 21*c*, 21*c*, . . . in one of the rows are twisted in an opposite direction from the nozzles in its adjacent row.

Also, the "uniform cooling width" relating to cooling is fixed by arrangement of the cooling nozzles. This means, considering properties of the plurality of cooling nozzles to be arranged, a size of the steel sheet 1 in the width direction with which a steel sheet to be passed can be cooled uniformly. Specifically, the uniform cooling width often corresponds to a width of the largest steel sheet that can be manufactured by a manufacturing apparatus of a steel sheet. In particular, the size shown by $W_u$ in FIG. 5 for example.

Here, in the embodiment, in the rows A, B, and C of nozzles adjacent to one another as shown above, the cooling nozzles in one of the rows are twisted in an opposite direction from the nozzles in its adjacent row. However, a configuration is not limited to this; and the cooling nozzles may be configured to be twisted to a same direction. The twisting angle (angle β as shown above) is not particularly limited either; and the twisting angle may be adequately determined in view of required cooling capability and well fitting of disposed equipments. Further, in the embodiment, in view of the above benefits, the rows A, B and C of nozzles adjacent to one another in the passing direction of the steel sheet are arranged in a zigzag manner. However, a configuration is not limited to this; and the cooling nozzles may be configured to be aligned in a linear manner in the sheet passing direction.

A position where the upper surface water supplying device 21 is provided in the sheet passing direction (a direction of the pass line P) is not particularly limited; however, the upper surface water supplying device 21 is preferably arranged as follows. That is, a part of the cooling apparatus 20 is disposed right after the final stand 11*g* in the row of hot finish rolling mills 11, from inside the housing 11*gh* of the final stand 11*g*, in a manner as closely to the work roll 11*gw* in the final stand 11*g* as possible. This arrangement enables rapid cooling of the steel sheet 1 immediately after it has been rolled by the row of hot finish rolling mills 11. It is also possible to stably guide the top portion of the steel sheet 1 into the cooling apparatus 20. A position at height of the upper surface water supplying device 21 is along the position of the upper surface guide 30 disposed in a manner to satisfy the formula (1) mentioned below. However, a portion in the housing 11*gh* of the final stand 11*g* is arranged in a manner to be close to the pass line P (the steel sheet 1), in other words, arranged in a manner to be low.

A direction in which the cooling water is sprayed from the cooling water ejection outlet of each of the cooling nozzles 21*c*, 21*c*, . . . is basically a vertical direction; however, the ejection of the cooling water from the cooling nozzle that is closest to the work roll 11*gw* of the final stand 11*g* is preferably directed more toward the work roll 11*gw* than vertically. This configuration can further shorten the time period from reduction of the steel sheet 1 in the final stand 11*g* to initiation of cooling the steel sheet. And the recovery time of rolling strains accumulated by rolling can also be reduced to almost zero. Therefore, a fine-grained steel sheet can be manufactured.

The lower surface water supplying devices 22, 22, . . . are devices to supply cooling water to the lower surface side of the steel sheet 1, in other words, supply cooling water from underneath of the pass line P. The lower surface water supplying devices 22, 22, . . . comprise: cooling headers 22*a*, 22*a*, . . . ; conduits 22*b*, 22*b*, . . . respectively provided to the cooling headers 22*a*, 22*a*, . . . in a form of a plurality of rows; and cooling nozzles 22*c*, 22*c*, . . . respectively attached to end portions of the conduits 22*b*, 22*b*, . . . . The lower surface water supplying devices 22, 22, . . . are arranged opposite to the above described upper surface water supplying devices 21, 21, . . . ; thus, a direction of a jet of cooling water by the lower surface water supplying device differs from that by the upper surface water supplying device. However, the lower surface water supplying device is generally the same in structure as the upper surface water supplying device; so the descriptions of the lower surface water supplying device will be omitted.

Next, upper surface guides 30, 30, . . . will be described. The upper surface guides 30, 30, . . . are sheet-shaped members, and are disposed between the upper surface water supplying device 21 and the pass line P (the steel sheet 1) so that the top portion of the steel sheet 1 does not get stuck with the conduits 21*b*, 21*b*, . . . and the cooling nozzles 21*c*, 21*c*, . . . , when the top portion of the steel sheet 1 is passed. Each of the upper surface guides 30, 30, . . . is provided with an inlet hole(s) which allow(s) a jet of water from the upper surface water supplying device 21 to pass. This configuration enables the jet of water from the upper surface water supplying device 21 to pass the upper surface guides 30, 30, . . . and reach the upper surface of the steel sheet 1, whereby it is possible to cool the steel sheet 1 efficiently. Herein, the shape of the upper surface guide 30 is not particularly limited; and a known upper surface guide can be used.

The upper surface guides 30, 30, . . . are arranged as shown in FIG. 2. In the embodiment, three upper surface guides 30, 30, 30 are used, and they are aligned in a line direction of the pass line P. All of the upper surface guides 30, 30, 30 are arranged so as to correspond to a position at height of the cooling nozzles 21*c*, 21, . . . . The upper surface guides 30, 30, . . . are arranged in a position at height in a manner to satisfy the formula (1) described below. As can be seen from FIGS. 2A and 2B, the portion of the final stand 11*g* in the housing 11*gh* is positioned in a tilted manner to get close to the pass line P (the steel sheet 1) corresponding to the position at height of the nozzles 21*c*, 21, . . . .

The lower surface guides 35, 35, . . . are sheet-shaped members arranged between the lower surface water supplying device 22 and the pass line P (the steel sheet 1). This arrangement enables to prevent a top end of the steel sheet from getting stuck with the lower surface water supplying devices 22, 22, . . . and the transporting rolls 12, 12, . . . especially when the steel sheet 1 is passed into the manufacturing apparatus 10. Further, the lower surface guides 35, 35, . . . are provided with an inlet hole(s) that allow(s) a jet of water from the lower surface water supplying devices 22, 22, . . . to pass. This configuration enables the jet of water from the lower surface water supplying devices 22, 22, . . . to pass the lower surface guide 35 and reach the lower surface of the steel sheet 1, whereby it is possible to cool the steel sheet 1 efficiently. The shape of the lower surface guide 35 to be used is not particularly limited; and a known lower surface guide can be used.

The lower surface guides 35, 35, . . . , which have been described above are arranged as shown in FIG. 2. In the embodiment, four lower surface guides 35, 35, . . . are used and they are respectively disposed between the transporting rolls 12, 12, 12, and between the work roll 11*gw* and the pinch roll 13. All of the lower surface guides 35, 35, . . . are disposed at a position that is not too low in relation to upper end portions of the transporting rolls 12, 12, . . . .

In the embodiment, an example in which the lower surface guide is provided has been described; however, the lower surface guide does not have to be disposed.

The transporting rolls 12, 12, . . . of the manufacturing apparatus 10 are rolls to transport the steel sheet 1 to the downstream side, and are aligned having predetermined intervals in the line direction of the pass line P.

The pinch roll 13 also functions to remove water, and is disposed on a downstream side from the cooling apparatus 20. This pinch roll can prevent cooling water sprayed in the cooling apparatus 20 from flowing out to the downstream side. Furthermore, the pinch roll prevents the steel sheet 1 from ruffling in the cooling apparatus 20, and improves a passing ability of the steel sheet 1 especially at a time before the top portion of the steel sheet enters in a coiler. Here, an upper-side roll 13*a* of the pinch roll 13 is movable upside down, as shown in FIG. 2A.

A steel sheet is manufactured by the above described manufacturing apparatus of a hot-rolled steel sheet 10, for example, in the following way. After the steel sheet 1 is coiled by the coiler, the ejection of cooling water in the cooling apparatus 20 is stopped during a non-rolling time until rolling of the next steel sheet is started. During the non-rolling time, the upper-side roll 13*a* of the pinch roll 13 on the downstream side of the cooling apparatus 20 is moved up to a position higher than the upper surface guide 30 of the cooling apparatus 20; then rolling of the next steel sheet 1 is started. When the top portion of the next steel sheet 1 reaches the pinch roll 13, cooling by the ejection of cooling water is started. And immediately after the top portion of the steel sheet passes through the pinch roll 13, the upper side roll 13*a* is lowered to start pinching the steel sheet 1. At this time, cooling water supplied to the upper surface side of the steel sheet 1 is, after cooling the steel sheet 1, discharged from both edges of the steel sheet 1 in the width direction of steel sheet.

By starting spraying cooling water before the top portion of the steel sheet 1 is transported into the cooling apparatus 20, it is possible to shorten a length of unsteady cooling portion of the top portion of the steel sheet 1. In addition to this, the sprayed cooling water is capable of stabilizing a passing ability of the steel sheet 1. In other words, in a case when the steel sheet 1 rises, trying to come close to the upper surface guide 30, an impact force received from the jets of cooling water sprayed by the cooling nozzles 21*c*, 21*c*, . . . increases and a vertically downward force acts on the steel sheet 1. As such, even in a case when the steel sheet 1 strikes against the upper surface guide 30, the impact of the steel sheet on the upper surface guide is eased by the impact force received from the jets of cooling water. Also, since friction heat between the steel sheet 1 and the upper surface guide 30 is reduced, it is possible to reduce abrasion defects produced on the surface of the steel sheet. Therefore, if a hot-rolled steel sheet is manufactured by the manufacturing apparatus 10 of a hot-rolled steel sheet comprising the cooling apparatus 20 operated as above on the downstream side of the row of hot finish rolling mills 11, cooling with a large volume of cooling water with a high volume density becomes possible. In other words, by manufacturing a hot-rolled steel sheet with the manufacturing method, the hot-rolled steel sheet with a fine-grained structure is obtained.

Further, a sheet passing rate in the row of hot finish rolling mills can be kept constant except for the area in which the steel sheet starts to pass. This enables manufacturing of a steel sheet with an enhanced mechanical strength over the entire length of the steel sheet.

Figure 6:
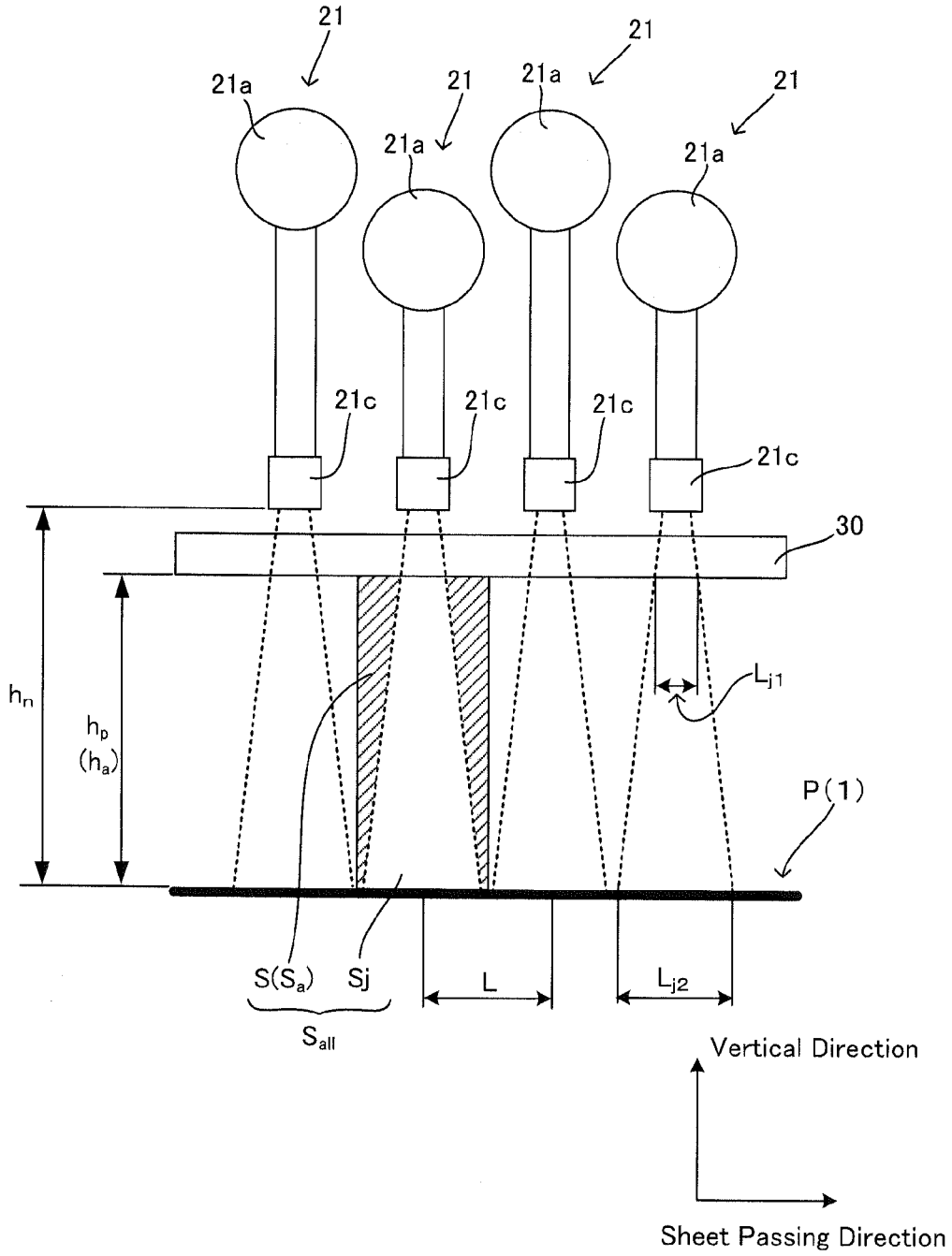
FIG. 6 is a view to describe the formula (1).

The cooling apparatus 20 in the embodiment further has the following characteristics. The characteristics will be described with reference of FIG. 6. FIG. 6 is an enlarged view schematically showing an area of the cooling apparatus 20. FIG. 6 shows a positional relationship of the upper surface water supplying devices 21, 21, . . . , the upper surface guide 30, and the pass line P. In FIG. 6, left on the sheet of paper is the upstream side, right on the sheet of paper is the downstream side, and a direction from top to bottom on the sheet of paper is a vertical direction of the manufacturing apparatus 10. Therefore, a direction from back to front on the sheet of paper is the width direction of steel sheet.

When a pitch between the adjacent upper surface water supplying devices 21, 21 in the line direction of the pass line P is defined as L (m), a water volume density of cooling water sprayed from the nozzle 21*c* is defined as $q_m$ ($m^3/m^2 \cdot sec$), a uniform cooling width of the cooling apparatus is defined as $W_u$ (m) (see FIG. 5), a cross-sectional area of virtual flow path of discharging water sprayed from one upper surface water supplying device 21 shown as shaded areas in FIG. 6 is defined as S ($m^2$), and a distance between the pass line P and the lower surface of the upper surface guide 30 is defined as $h_p$ (m), the following formula (1) is satisfied.

$$0.08 \cdot \frac{q_m \cdot W_u \cdot L}{S \cdot \sqrt{h_p}} \leqq 1 \quad (1)$$

Herein, the cross-sectional area of virtual flow path S ($m^2$) is obtained as follows. A cross-sectional area $S_{all}$ that cooling water sprayed on the upper surface of the steel sheet 1 possibly has when discharged in the width direction of the steel sheet is represented by the following formula (2) per upper surface water supplying device 21.

$$S_{all}=h_p \cdot L \quad (2)$$

However, $S_{a11}$ includes an area where cooling water sprayed passes. Therefore, it is necessary to exclude the area where cooling water sprayed passes from a cross-sectional area of flow path for discharging water. If the area to be excluded is defined as $S_j$ ($m^2$), the cross-sectional area of flow path for discharging water can be represented by the following formula (3).

$$S_j=\tfrac{1}{2}(L_{j1}+L_{j2}) \cdot h_p \quad (3)$$

Here, $L_{j1}$ is, as shown in FIG. 6, in a cross section of the jet in a jet direction, a length in the sheet passing direction (m) of the cross section of the jet in the jet direction, the length of a portion that passes the upper surface guide 30. On the other hand, $L_{j2}$ is a length on the pass line P same as (m). Therefore, the cross-sectional area S of virtual flow path can be obtained by the following formula (4).

$$S=S_{all}-S_j \quad (4)$$

The formula (4) and the formula (1) in which the formula (4) is substituted can be applied to nozzles in any forms. As an example, when a flat nozzle is used, and a spread angle of the flat nozzle in the sheet passing direction is defined as $\theta_n$, the above $L_{j1}$ and $L_{j2}$ are represented by the formula (5) and the formula (6).

$$L_{j1} = 2 \cdot (h_n - h_p) \cdot \tan\left(\frac{\theta_n}{2}\right) \quad (5)$$

$$L_{j2} = 2 \cdot h_n \cdot \tan\left(\frac{\theta_n}{2}\right) \quad (6)$$

Here, $h_n$ (m) represents a distance between the top portion of the nozzle and the pass line P.

Also, in the formula (1), in view of manufacturing a hot-rolled steel sheet with a fine-grained structure and good mechanical properties, the water volume density of cooling water $q_m$ is 0.16 $m^3/(m^2 \cdot sec)$ (10 $m^3/(m^2 \cdot min)$) or more.

By various exams and the like such as Examples mentioned below based on the above idea, it was found out that, according to the cooling apparatus in which the above formula (1) is satisfied, and the manufacturing apparatus comprising the cooling apparatus, it is possible to cool a steel sheet using a large volume of cooling water with a high water volume density, and it is also possible to discharge the water efficiently. In other words, by manufacturing a hot-rolled steel sheet using the manufacturing apparatus of a hot-rolled steel sheet, it is possible to manufacture a hot-rolled steel sheet with a fine-grained structure. More particularly, as a result of smooth discharging water, it is possible to prevent an upper surface of retained water from reaching the upper surface guide 30, whereby it is possible to efficiently cool the steel sheet 1. Further, smooth discharging water like this inhibits cooling non-uniformity in the width direction of the steel sheet 1, thereby enabling cooling more uniformly.

The left part of the formula (1) shows that, when a ratio of a secured cross-sectional area of the water discharging path to volume of provided cooling water, in other words, a ratio of a flowing speed of discharging water and a value obtained by the relationship of $h_p$, a distance between the upper surface of the steel sheet 1 and the lower surface of the upper surface guide 30, is increased, discharging water becomes difficult.

Figure 7:
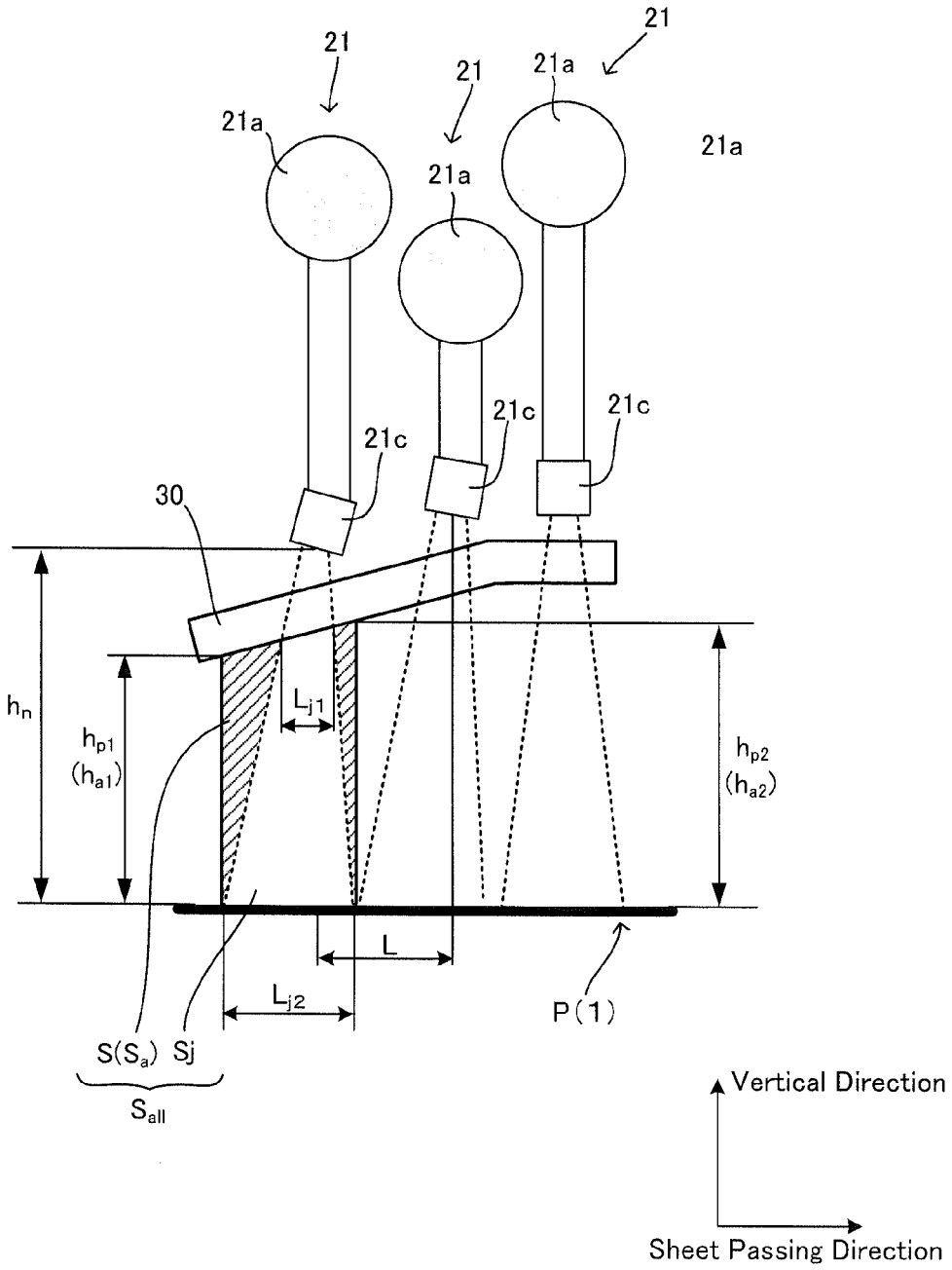
FIG. 7 is a view illustrating a portion in which an upper surface guide is inclined.

In the above formulas (1) to (6), a portion in which the upper surface guide 30 is disposed substantially parallel to the pass line P has been described. As shown in FIG. 2B, a portion in which the upper surface guide 30 is disposed in a tilted manner can be considered in the same way. FIG. 7 is a view corresponding to FIG. 6, showing the portion in which the upper surface guide 30 is disposed in a tilted manner.

When the upper surface guide 30 is disposed in a tilted manner as described above, in the formulas (1) to (6), the corresponding height $h_p'$ of the upper surface guide 30 is applied instead of $h_p$, the distance between the pass line P and the lower surface of the upper surface guide 30. In the embodiment, the corresponding height $h_p'$ is obtained by the following formula (7).

$$h_p' = \frac{h_{p1} + h_{p2}}{2} \quad (7)$$

Here, as can be seen from FIG. 7, $h_{p1}$ is a distance between the pass line P and the lower surface of the upper surface guide 30 that are on an upper process side in the areas that configure $S_{all}$. On the other hand, $h_{p2}$ is a distance between the pass line P and the lower surface of the upper surface guide 30 that are on a lower process side in the areas that configure $S_{a11}$.

As shown the above, the formula (1) is a formula to determine the distance between the pass line P (the steel sheet 1) and the upper surface guide 30, using flowing amount of cooling water flowing between the pass line P (the steel sheet 1) and the upper surface guide 30, and the cross-sectional area of virtual flow path of the cooling water into the formula (1). Therefore, this way can be also applied to a case in which the upper surface guide 30 is not disposed parallel to the pass line P (the steel sheet 1). Especially, it is important to cool rapidly the area shown in FIG. 2B in order to obtain fine-grained ferrite, by not merely enlarging the volume density of the cooling water, but holding an upper limit of the volume density of the cooling water within the range of the formula (1), it is possible to inhibit overflow of the retained water, which works well for effective cooling.

Figure 8:
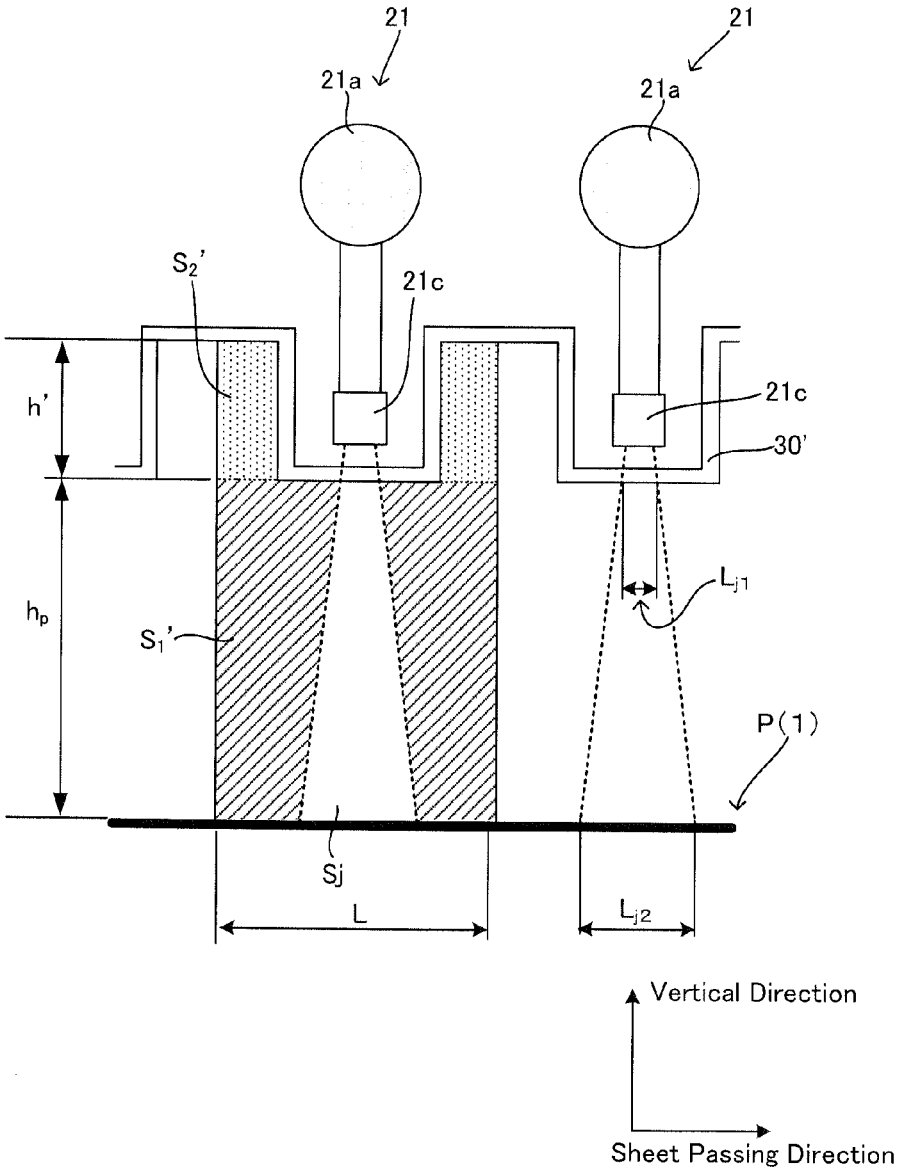
FIG. 8 is a view illustrating an example in which the upper surface guide is not flat.

An example in which the upper surface guide 30 has a plain-sheet shape has been described above. However, in view of improving discharging capability, an upper surface guide that has an uneven shape may be applied. FIG. 8 shows an example in which an upper surface guide 30' is applied. FIG. 8 corresponds to FIGS. 6 and 7.

In the example shown in FIG. 8, at a portion of the upper surface guide 30', where the cooling nozzle 21*c* is disposed, a distance between the pass line P and the lower surface of the upper surface guide 30' is $h_p$. On the other hand, between the adjacent cooling nozzles 21*c*, 21*c*, the distance between the pass line P and the lower surface of the upper surface guide 30' is defined as $h_p$+h'. Even when the upper surface guide 30' as above is applied, basically the same idea as the formulas (1) to (7) can be applied. However, considering that the cross-sectional area of virtual flow path for discharging water has been increased by applying the upper surface guide 30', a cross-sectional area of virtual flow passage S' that has been changed and a corresponding height $h_p'$ that has also been changed are applied instead of S and $h_p$ in the formula (1). In the embodiment, S' can be obtained from the formula (8), and $h_p'$ can be obtained from the formula (9).

$$S'=S_1'+S_2' \tag{8}$$

$$h_p'=h_p\cdot\sqrt{e} \tag{9}$$

Here, $S_1'$ in the formula (8) is a cross-sectional area of virtual flow path in a portion having the height $h_p$, as shown by hutching in FIG. 8, and same as S in the formula (1). On the other hand, $S_2'$ in the formula (8) is a cross-sectional area of virtual flow path in a portion having the height h' as shown by gray area in FIG. 8. Therefore, when the upper guide 30' is applied, the cross-sectional area S' of virtual flow path that is obtained by the formula (8) is substituted in the formula (1) instead of the cross-sectional area of virtual flow path S.

The formula (9) is a formula to obtain the corresponding height $h_p'$ at the upper surface guide 30'. Here, r represents expanding rate of the cross-sectional area of virtual flow path, and r is obtained by $S'/S_1'$ in the embodiment. Therefore, it is also possible to apply the formula (1) to the upper surface guide 30' by using the corresponding height $h_p'$.

By applying the upper surface guide 30' as mentioned above, a cross-sectional area for discharging cooling water is enlarged and discharging capability can be further improved.

Figure 9:
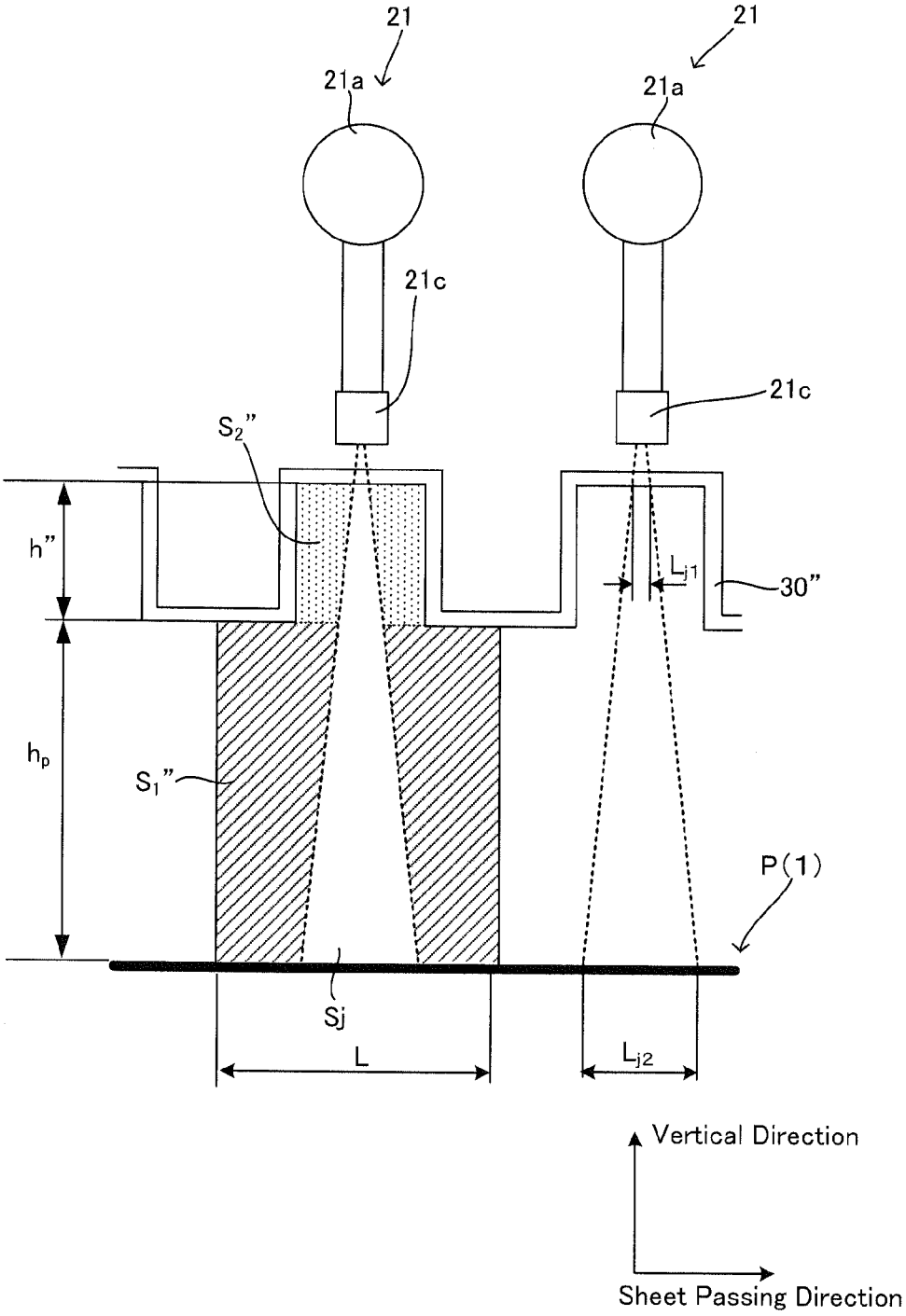
FIG. 9 is a view illustrating another example in which the upper surface is not flat.

FIG. 9 also shows another example in which an upper guide has an uneven shape. FIG. 9 shows an example in which an upper surface guide 30" is applied, and corresponds to FIGS. 6 and 7.

In the example shown in FIG. 9, in the area between the adjacent cooling nozzles 21*c*, 21*c* of the upper surface guide 30", the distance between the pass line P and the lower surface of the upper surface guide 30" is $h_p$. On the other hand, in the area where the cooling nozzle 21*c* is disposed, the distance between the pass line P and the upper surface guide 30" is defined as $h_p$+h". Even when the upper surface guide 30" as mentioned above is applied, basically the same idea as the formulas (1) to (7) can be applied. However, considering that the cross-sectional area of virtual flow path for discharging water has been increased by applying the upper surface guide 30", a cross-section area of virtual flow path S' that has been changed and the corresponding height $h_p'$ that has also been changed are applied instead of S and $h_p$ in the formula (1). In the embodiment, S' can be obtained from the formula (10), and $h_p'$ can be obtained from the formula (11).

$$S'=S_1''+S_2'' \tag{10}$$

$$h_p'=h_p\cdot\sqrt{r} \tag{11}$$

Here, $S_1''$ in the formula (10) is a cross-sectional area of virtual flow path in a portion having the height $h_p$ as shown by hatching in FIG. 9, and same as S in the formula (1). On the other hand, $S_2''$ in the formula (10) is a cross-sectional area of virtual flow path in a portion having the height h" as shown by gray in FIG. 9. Therefore, when the upper surface guide 30" is applied, the cross-sectional area of virtual flow path S' obtained by the formula (10) is substituted in the formula (1) instead of the cross-sectional area of virtual flow path S.

The formula (11) is a formula to obtain the corresponding height $h_p'$ at the upper surface guide 30". Here, r represents an expanding rate of the cross-sectional area of virtual flow path, and r is obtained by $S'/S_1''$ in the embodiment. Therefore it is possible to apply the formula (1) to the upper surface guide 30" by using the corresponding height $h_p'$.

By applying the upper surface guide 30" as above, the cross-sectional area for discharging cooling water is enlarged, and it is possible to improve discharging capability.

As shown in FIGS. 7 to 9, when the distance between the pass line P and the upper surface guide is changed in the sheet passing direction (pass line direction), the relationship of the formula (1) can be applied by using the corresponding height $h_p'$ as mentioned above.

Also, when a hot-rolled steel sheet is manufactured by using the cooling apparatus 20, the hot-rolled steel sheet can be manufactured so as to satisfy the formula (12). Namely, when a pitch between the upper surface water supplying devices 21, 21 that are adjacent to each other in the sheet passing direction is defined as L (m), the water volume density of cooling water sprayed from the nozzle 21*c* is defined as $q_a$ ($m^3/m^2\cdot sec$), a sheet width of the steel sheet to be passed is defined as $W_a$ (m), the cross-sectional area of virtual flow path of discharging water sprayed from one of the upper surface water supplying device 21 shown as a shaded area in FIG. 6 is defined as $S_a$ ($m^2$), and the distance between the upper surface of the steel sheet 1 to be passed and the lower surface of the upper guide 30 is defined as $h_a$ (m), the steel sheet is cooled so as to satisfy the following formula (12).

$$0.08\cdot\frac{q_a\cdot W_a\cdot L}{S_a\cdot\sqrt{h_a}}\leqq 1 \tag{12}$$

Here, $S_a$ ($m^2$) can be obtained by changing to calculate the formulas (2) to (7) based on the distance $h_a$ between the upper surface guide 30 and the steel sheet 1 instead of the distance $h_p$ between the upper surface guide 30 and the pass line P. As shown in FIGS. 7 to 9, also when the distance between the pass line P and the upper surface guide changes in the sheet passing direction (pass line direction), $S_a'$ corresponding to the cross-sectional area of the virtual flow path S' that has been changed, and the corresponding height $h_a'$ corresponding to the corresponding height $h_p'$ described above can be used.

Also, in the formula (12), in view of manufacturing a hot-rolled steel sheet with a fine-grained structure and good mechanical properties, the water volume density of cooling water $q_a$ is 0.16 $m^3/(m^2\cdot sec)$ (10 $m^3/(m^2\cdot min)$) or more.

According to the manufacturing method of a hot-rolled steel sheet as described above, it is possible to give manufacturing conditions and/or conditions of spraying cooling water and the like to satisfy the above formula (12) to the manufacturing apparatus, corresponding to relationship with other portions of the manufacturing apparatus and restriction by surrounding environment.

According to the cooling apparatus 20, the manufacturing apparatus 10 comprising the cooling apparatus 20, and the manufacturing method of a hot-rolled steel sheet that are described above, when a cooling water volume density to obtain required cooling ability, a width of steel sheet, and a pitch of the cooling nozzle are determined for example, a position of the upper surface guide can be set so as to satisfy the formula (1) and formula (12). Also, as in the cooling apparatus 20, in some cases, the upper surface guide 30 needs to get close to the pass line P on the upstream side, in other words, $h_p$ in the formula (1) and $h_a$ in the formula (12) are determined. In such cases, it is possible to change the cooling water volume density and the pitch of the nozzle so as to satisfy the formula (1) and the formula (12), and it is possible to know how much they need to be changed in advance.

Also, the upper limit of the position at height of the upper surface guide 30 is preferably 1 min view of sheet passing ability.

As described above, by the cooling apparatus of a hot-rolled steel sheet, and the manufacturing apparatus and manufacturing method of a hot-rolled steel sheet of the embodiment, in manufacturing a hot-rolled steel sheet, it is possible to discharge water smoothly even when the hot-rolled steel sheet needs to be cooled by water with a high cooling water volume density, and high cooling capability can be utilized efficiently.

Further, as a variation of the cooling apparatus of a steel sheet, and the manufacturing apparatus and manufacturing method of a hot-rolled steel sheet of the above described embodiment, the following configuration can be raised. Namely, a position at height of at least either one of the upper surface guide or the cooling nozzle of the cooling apparatus can be configured to be movable. With this configuration, it is possible to change $h_p$ and $h_a$ in the above formulas (1) and (12), and securing further efficient water discharging capability, it is possible to utilize high cooling capability. It should be noted that, however, in this case, the lower surface of the upper surface guide is not positioned higher than a lower end of the cooling nozzle of the upper surface water supplying device. Otherwise, the lower end of the cooling nozzle interrupts sheet passing.

Means to move the upper surface guide in top and bottom direction is not particularly limited; for example, the upper surface guide can be moved in top and bottom direction, by providing a cylinder to a place where a arm and a rail, which are to displace the upper surface guide when work rolls are exchanged, and the upper surface guide are connected, or moving the arm and the rail themselves up and down or the like.

EXAMPLES

The present invention will be described below more in detail on a basis of examples, to which the present invention is not limited. In the examples, each element of the formula (12) described above was changed, and the relationship with the water discharging performance was examined. The conditions and results were shown in tables 1 to 5. Tables 1 to 3 show examples in which each upper surface guide has a flat-sheet shape, and each distance between the pass line P and the upper surface guide is fixed in the sheet passing direction (pass line direction). Table 1 shows a case in which the width of the steel sheet is 1.0 m, Table 2 shows a case in which the width of the steel sheet is 1.6 m, and Table 3 shows a case in which the width of the steel sheet is 2.0 m. Tables 4 and 5 show examples in which each upper surface guide has an uneven shape as shown in FIG. 8 and each distance between the pass line P and the upper surface guide changes in the sheet passing direction (pass line direction). Table 4 shows a case in which h' in FIG. 8 is 0.1 m, and Table 5 shows a case in which h' in FIG. 8 is 0.2 m. The width of each steel sheet was 2.0 m.

In each table, water discharging performance was evaluated as follows. Namely, "x" was given if the top portion of the cooling nozzle sank in discharging water that flowed back from the hole where the jet of cooling water passes, and "o" was given if the cooling nozzle did not sink in the discharging water. This judgment is based on the following reason: if the top portion of the cooling nozzle sinks in water, jet form of the cooling water changes from in-air liquid jet (jet that passes in air) to in-liquid liquid jet (jet that passes in water) and the jet decays significantly, whereby the impact force of the jet to the hot-rolled steel sheet greatly decreases.

TABLE 1

| | Cooling Water Volume Density $q_a$ [$m^3/(m^2 \cdot sec)$] | Height of Upper Surface Guide $h_a$ [m] | Width of Steel Sheet $W_a$ [m] | Pitch of Header L [m] | Total Flowing Amount Q [$m^3$/sec] | Cross-ectional area of Virtual Flow Path $S_a$ [$m^2$] | Value of Left Part of Formula (12) | Discharging Performance Evaluation |
|---|---|---|---|---|---|---|---|---|
| 1-1 | 0.16 | 0.10 | 1.00 | 0.16 | 0.03 | 8.80E−03 | 0.77 | ○ |
| 1-2 | 0.16 | 0.15 | 1.00 | 0.16 | 0.03 | 1.32E−02 | 0.42 | ○ |
| 1-3 | 0.16 | 0.20 | 1.00 | 0.16 | 0.03 | 1.76E−02 | 0.27 | ○ |
| 1-4 | 0.16 | 0.25 | 1.00 | 0.16 | 0.03 | 2.20E−02 | 0.19 | ○ |
| 1-5 | 0.16 | 0.30 | 1.00 | 0.16 | 0.03 | 2.64E−02 | 0.15 | ○ |
| 1-6 | 0.25 | 0.10 | 1.00 | 0.16 | 0.04 | 8.80E−03 | 1.15 | X |
| 1-7 | 0.25 | 0.15 | 1.00 | 0.16 | 0.04 | 1.32E−02 | 0.63 | ○ |
| 1-8 | 0.25 | 0.20 | 1.00 | 0.16 | 0.04 | 1.76E−02 | 0.41 | ○ |
| 1-9 | 0.25 | 0.25 | 1.00 | 0.16 | 0.04 | 2.20E−02 | 0.29 | ○ |
| 1-10 | 0.25 | 0.30 | 1.00 | 0.16 | 0.04 | 2.64E−02 | 0.22 | ○ |
| 1-11 | 0.33 | 0.10 | 1.00 | 0.16 | 0.05 | 8.80E−03 | 1.53 | X |
| 1-12 | 0.33 | 0.15 | 1.00 | 0.16 | 0.05 | 1.32E−02 | 0.83 | ○ |
| 1-13 | 0.33 | 0.20 | 1.00 | 0.16 | 0.05 | 1.76E−02 | 0.54 | ○ |
| 1-14 | 0.33 | 0.25 | 1.00 | 0.16 | 0.05 | 2.20E−02 | 0.39 | ○ |
| 1-15 | 0.33 | 0.30 | 1.00 | 0.16 | 0.05 | 2.64E−02 | 0.30 | ○ |
| 1-16 | 0.42 | 0.10 | 1.00 | 0.16 | 0.07 | 8.80E−03 | 1.92 | X |
| 1-17 | 0.42 | 0.15 | 1.00 | 0.16 | 0.07 | 1.32E−02 | 1.04 | X |
| 1-18 | 0.42 | 0.20 | 1.00 | 0.16 | 0.07 | 1.76E−02 | 0.68 | ○ |
| 1-19 | 0.42 | 0.25 | 1.00 | 0.16 | 0.07 | 2.20E−02 | 0.48 | ○ |
| 1-20 | 0.42 | 0.30 | 1.00 | 0.16 | 0.07 | 2.64E−02 | 0.37 | ○ |

TABLE 2

| | Cooling Water Volume Density $q_a$ [$m^3/(m^2 \cdot sec)$] | Height of Upper Surface Guide $h_a$ [m] | Width of Steel Sheet $W_a$ [m] | Pitch of Header L [m] | Total Flowing Amount Q [$m^3$/sec] | Cross-sectional area of Virtual Flow Path $S_a$ [$m^2$] | Value of Left Part of Formula (12) | Discharging Performance Evaluation |
|---|---|---|---|---|---|---|---|---|
| 2-1 | 0.16 | 0.10 | 1.60 | 0.16 | 0.04 | 8.80E−03 | 1.23 | X |
| 2-2 | 0.16 | 0.15 | 1.60 | 0.16 | 0.04 | 1.32E−02 | 0.67 | ○ |
| 2-3 | 0.16 | 0.20 | 1.60 | 0.16 | 0.04 | 1.76E−02 | 0.43 | ○ |
| 2-4 | 0.16 | 0.25 | 1.60 | 0.16 | 0.04 | 2.20E−02 | 0.31 | ○ |
| 2-5 | 0.16 | 0.30 | 1.60 | 0.16 | 0.04 | 2.64E−02 | 0.24 | ○ |
| 2-6 | 0.25 | 0.10 | 1.60 | 0.16 | 0.06 | 8.80E−03 | 1.84 | X |
| 2-7 | 0.25 | 0.15 | 1.60 | 0.16 | 0.06 | 1.32E−02 | 1.002 | X |
| 2-8 | 0.25 | 0.20 | 1.60 | 0.16 | 0.06 | 1.76E−02 | 0.65 | ○ |
| 2-9 | 0.25 | 0.25 | 1.60 | 0.16 | 0.06 | 2.20E−02 | 0.47 | ○ |
| 2-10 | 0.25 | 0.30 | 1.60 | 0.16 | 0.06 | 2.64E−02 | 0.35 | ○ |
| 2-11 | 0.33 | 0.10 | 1.60 | 0.16 | 0.09 | 8.80E−03 | 2.45 | X |
| 2-12 | 0.33 | 0.15 | 1.60 | 0.16 | 0.09 | 1.32E−02 | 1.34 | X |
| 2-13 | 0.33 | 0.20 | 1.60 | 0.16 | 0.09 | 1.76E−02 | 0.87 | ○ |
| 2-14 | 0.33 | 0.25 | 1.60 | 0.16 | 0.09 | 2.20E−02 | 0.62 | ○ |
| 2-15 | 0.33 | 0.30 | 1.60 | 0.16 | 0.09 | 2.64E−02 | 0.47 | ○ |
| 2-16 | 0.42 | 0.10 | 1.60 | 0.16 | 0.11 | 8.80E−03 | 3.07 | X |
| 2-17 | 0.42 | 0.15 | 1.60 | 0.16 | 0.11 | 1.32E−02 | 1.67 | X |
| 2-18 | 0.42 | 0.20 | 1.60 | 0.16 | 0.11 | 1.76E−02 | 1.08 | X |
| 2-19 | 0.42 | 0.25 | 1.60 | 0.16 | 0.11 | 2.20E−02 | 0.78 | ○ |
| 2-20 | 0.42 | 0.30 | 1.60 | 0.16 | 0.11 | 2.64E−02 | 0.59 | ○ |

TABLE 3

| | Cooling Water Volume Density $q_a$[$m^3/(m^2 \cdot sec)$] | Height of Upper Surface Guide $h_a$ [m] | Width of Steel Sheet $W_a$ [m] | Pitch of Header L [m] | Total Flowing Amount Q [$m^3$/sec] | Cross-sectional area of Virtual Flow Path $S_a$ [$m^2$] | Value of Left Part of Formula (12) | Discharging Performance Evaluation |
|---|---|---|---|---|---|---|---|---|
| 3-1 | 0.16 | 0.10 | 2.00 | 0.16 | 0.05 | 8.80E−03 | 1.53 | X |
| 3-2 | 0.16 | 0.15 | 2.00 | 0.16 | 0.05 | 1.32E−02 | 0.83 | ○ |
| 3-3 | 0.16 | 0.20 | 2.00 | 0.16 | 0.05 | 1.76E−02 | 0.54 | ○ |
| 3-4 | 0.16 | 0.25 | 2.00 | 0.16 | 0.05 | 2.20E−02 | 0.39 | ○ |
| 3-5 | 0.16 | 0.30 | 2.00 | 0.16 | 0.05 | 2.64E−02 | 0.30 | ○ |
| 3-6 | 0.25 | 0.10 | 2.00 | 0.16 | 0.08 | 8.80E−03 | 2.30 | X |
| 3-7 | 0.25 | 0.15 | 2.00 | 0.16 | 0.08 | 1.32E−02 | 1.25 | X |
| 3-8 | 0.25 | 0.20 | 2.00 | 0.16 | 0.08 | 1.76E−02 | 0.81 | ○ |
| 3-9 | 0.25 | 0.25 | 2.00 | 0.16 | 0.08 | 2.20E−02 | 0.58 | ○ |
| 3-10 | 0.25 | 0.30 | 2.00 | 0.16 | 0.08 | 2.64E−02 | 0.44 | ○ |
| 3-11 | 0.33 | 0.10 | 2.00 | 0.16 | 0.11 | 8.80E−03 | 3.07 | X |
| 3-12 | 0.33 | 0.15 | 2.00 | 0.16 | 0.11 | 1.32E−02 | 1.67 | X |
| 3-13 | 0.33 | 0.20 | 2.00 | 0.16 | 0.11 | 1.76E−02 | 1.08 | X |
| 3-14 | 0.33 | 0.25 | 2.00 | 0.16 | 0.11 | 2.20E−02 | 0.78 | ○ |
| 3-15 | 0.33 | 0.30 | 2.00 | 0.16 | 0.11 | 2.64E−02 | 0.59 | ○ |
| 3-16 | 0.42 | 0.10 | 2.00 | 0.16 | 0.13 | 8.80E−03 | 3.83 | X |
| 3-17 | 0.42 | 0.15 | 2.00 | 0.16 | 0.13 | 1.32E−02 | 2.09 | X |
| 3-18 | 0.42 | 0.20 | 2.00 | 0.16 | 0.13 | 1.76E−02 | 1.36 | X |
| 3-19 | 0.42 | 0.25 | 2.00 | 0.16 | 0.13 | 2.20E−02 | 0.97 | ○ |
| 3-20 | 0.42 | 0.30 | 2.00 | 0.16 | 0.13 | 2.64E−02 | 0.74 | ○ |

In the examples in Tables 4 and 5, each upper surface guide has an uneven shape as described above. Therefore, the cross-sectional area of virtual flow path $S_a'$ (S') that has been changed from S, and the corresponding height $h_a'$ ($h_p'$) that has also been changed from $h_a$ ($h_p$) were obtained from the formulas (8) and (9). The left part of the formula (12) was calculated based on the obtained $S_a'$ (S') and $h_a'$ ($h_p'$).

TABLE 4

| | Cooling Water Volume Density | Height Described in FIG. 8 | | Width of Steel Sheet | Pitch of Header | Total Flowing Amount | Cross-sectional area of Virtual Flow Path $S'_a$(S') | | Corresponding Height | Value of Left Part of | Discharging Performance |
|---|---|---|---|---|---|---|---|---|---|---|---|
| | $q_a$[$m^3/(m^2 \cdot sec)$] | $h_a(h_p)$ [m] | h' [m] | $W_a$ [m] | L [m] | Q [$m^3$/sec] | $S_1'$ [$m^2$] | $S_2'$ [$m^2$] | $h_a'$ [m] | Formula (12) | Evaluation |
| 4-1 | 0.16 | 0.10 | 0.10 | 2.00 | 0.16 | 0.05 | 8.80E−03 | 7.60E−03 | 0.14 | 0.70 | ○ |
| 4-2 | 0.16 | 0.15 | 0.10 | 2.00 | 0.16 | 0.05 | 1.32E−02 | 7.60E−03 | 0.19 | 0.47 | ○ |
| 4-3 | 0.16 | 0.20 | 0.10 | 2.00 | 0.16 | 0.05 | 1.76E−02 | 7.60E−03 | 0.24 | 0.35 | ○ |
| 4-4 | 0.16 | 0.25 | 0.10 | 2.00 | 0.16 | 0.05 | 2.20E−02 | 7.60E−03 | 0.29 | 0.27 | ○ |
| 4-5 | 0.16 | 0.30 | 0.10 | 2.00 | 0.16 | 0.05 | 2.64E−02 | 7.60E−03 | 0.34 | 0.21 | ○ |
| 4-6 | 0.25 | 0.10 | 0.10 | 2.00 | 0.16 | 0.08 | 8.80E−03 | 7.60E−03 | 0.14 | 1.05 | X |

TABLE 4-continued

| | Cooling Water Volume Density | Height Described in FIG. 8 | | Width of Steel Sheet | Pitch of Header | Total Flowing Amount | Cross-sectional area of Virtual Flow Path $S'_a(S')$ | | Corresponding Height | Value of Left Part of | Discharging Performance |
|---|---|---|---|---|---|---|---|---|---|---|---|
| | $q_a$[m$^3$/(m$^2$ · sec)] | $h_a(h_p)$ [m] | h' [m] | $W_a$ [m] | L [m] | Q [m$^3$/sec] | $S_1'$ [m$^2$] | $S_2'$ [m$^2$] | $h_a'$ [m] | Formula (12) | Evaluation |
| 4-7 | 0.25 | 0.15 | 0.10 | 2.00 | 0.16 | 0.08 | 1.32E−02 | 7.60E−03 | 0.19 | 0.71 | ○ |
| 4-8 | 0.25 | 0.20 | 0.10 | 2.00 | 0.16 | 0.08 | 1.76E−02 | 7.60E−03 | 0.24 | 0.52 | ○ |
| 4-9 | 0.25 | 0.25 | 0.10 | 2.00 | 0.16 | 0.08 | 2.20E−02 | 7.60E−03 | 0.29 | 0.40 | ○ |
| 4-10 | 0.25 | 0.30 | 0.10 | 2.00 | 0.16 | 0.08 | 2.64E−02 | 7.60E−03 | 0.34 | 0.32 | ○ |
| 4-11 | 0.33 | 0.10 | 0.10 | 2.00 | 0.16 | 0.11 | 8.80E−03 | 7.60E−03 | 0.14 | 1.41 | X |
| 4-12 | 0.33 | 0.15 | 0.10 | 2.00 | 0.16 | 0.11 | 1.32E−02 | 7.60E−03 | 0.19 | 0.94 | ○ |
| 4-13 | 0.33 | 0.20 | 0.10 | 2.00 | 0.16 | 0.11 | 1.76E−02 | 7.60E−03 | 0.24 | 0.69 | ○ |
| 4-14 | 0.33 | 0.25 | 0.10 | 2.00 | 0.16 | 0.11 | 2.20E−02 | 7.60E−03 | 0.29 | 0.53 | ○ |
| 4-15 | 0.33 | 0.30 | 0.10 | 2.00 | 0.16 | 0.11 | 2.64E−02 | 7.60E−03 | 0.34 | 0.43 | ○ |
| 4-16 | 0.42 | 0.10 | 0.10 | 2.00 | 0.16 | 0.13 | 8.80E−03 | 7.60E−03 | 0.14 | 1.76 | X |
| 4-17 | 0.42 | 0.15 | 0.10 | 2.00 | 0.16 | 0.13 | 1.32E−02 | 7.60E−03 | 0.19 | 1.18 | X |
| 4-18 | 0.42 | 0.20 | 0.10 | 2.00 | 0.16 | 0.13 | 1.76E−02 | 7.60E−03 | 0.24 | 0.86 | ○ |
| 4-19 | 0.42 | 0.25 | 0.10 | 2.00 | 0.16 | 0.13 | 2.20E−02 | 7.60E−03 | 0.29 | 0.67 | ○ |
| 4-20 | 0.42 | 0.30 | 0.10 | 2.00 | 0.16 | 0.13 | 2.64E−02 | 7.60E−03 | 0.34 | 0.54 | ○ |

TABLE 5

| | Cooling Water Volume Density | Height Described in FIG. 8 | | Width of Steel Sheet | Pitch of Header | Total Flowing Amount | Cross-sectional area of Virtual Flow Path $S'_a(S')$ | | Corresponding Height | Value of Left Part of | Discharging Performance |
|---|---|---|---|---|---|---|---|---|---|---|---|
| | $q_a$[m$^3$/(m$^2$ · sec)] | $h_a(h_p)$ [m] | h' [m] | $W_a$ [m] | L [m] | Q [m$^3$/sec] | $S_1'$ [m$^2$] | $S_2'$ [m$^2$] | $h_a'$ [m] | Formula (12) | Evaluation |
| 5-1 | 0.16 | 0.10 | 0.20 | 2.00 | 0.16 | 0.05 | 8.80E−03 | 1.52E−02 | 0.17 | 0.44 | ○ |
| 5-2 | 0.16 | 0.15 | 0.20 | 2.00 | 0.16 | 0.05 | 1.32E−02 | 1.52E−02 | 0.22 | 0.32 | ○ |
| 5-3 | 0.16 | 0.20 | 0.20 | 2.00 | 0.16 | 0.05 | 1.76E−02 | 1.52E−02 | 0.27 | 0.25 | ○ |
| 5-4 | 0.16 | 0.25 | 0.20 | 2.00 | 0.16 | 0.05 | 2.20E−02 | 1.52E−02 | 0.33 | 0.20 | ○ |
| 5-5 | 0.16 | 0.30 | 0.20 | 2.00 | 0.16 | 0.05 | 2.64E−02 | 1.52E−02 | 0.38 | 0.17 | ○ |
| 5-6 | 0.25 | 0.10 | 0.20 | 2.00 | 0.16 | 0.08 | 8.80E−03 | 1.52E−02 | 0.17 | 0.66 | ○ |
| 5-7 | 0.25 | 0.15 | 0.20 | 2.00 | 0.16 | 0.08 | 1.32E−02 | 1.52E−02 | 0.22 | 0.48 | ○ |
| 5-8 | 0.25 | 0.20 | 0.20 | 2.00 | 0.16 | 0.08 | 1.76E−02 | 1.52E−02 | 0.27 | 0.37 | ○ |
| 5-9 | 0.25 | 0.25 | 0.20 | 2.00 | 0.16 | 0.08 | 2.20E−02 | 1.52E−02 | 0.33 | 0.30 | ○ |
| 5-10 | 0.25 | 0.30 | 0.20 | 2.00 | 0.16 | 0.08 | 2.64E−02 | 1.52E−02 | 0.38 | 0.25 | ○ |
| 5-11 | 0.33 | 0.10 | 0.20 | 2.00 | 0.16 | 0.11 | 8.80E−03 | 1.52E−02 | 0.17 | 0.87 | ○ |
| 5-12 | 0.33 | 0.15 | 0.20 | 2.00 | 0.16 | 0.11 | 1.32E−02 | 1.52E−02 | 0.22 | 0.64 | ○ |
| 5-13 | 0.33 | 0.20 | 0.20 | 2.00 | 0.16 | 0.11 | 1.76E−02 | 1.52E−02 | 0.27 | 0.50 | ○ |
| 5-14 | 0.33 | 0.25 | 0.20 | 2.00 | 0.16 | 0.11 | 2.20E−02 | 1.52E−02 | 0.33 | 0.40 | ○ |
| 5-15 | 0.33 | 0.30 | 0.20 | 2.00 | 0.16 | 0.11 | 2.64E−02 | 1.52E−02 | 0.38 | 0.33 | ○ |
| 5-16 | 0.42 | 0.10 | 0.20 | 2.00 | 0.16 | 0.13 | 8.80E−03 | 1.52E−02 | 0.17 | 1.09 | X |
| 5-17 | 0.42 | 0.15 | 0.20 | 2.00 | 0.16 | 0.13 | 1.32E−02 | 1.52E−02 | 0.22 | 0.80 | ○ |
| 5-18 | 0.42 | 0.20 | 0.20 | 2.00 | 0.16 | 0.13 | 1.76E−02 | 1.52E−02 | 0.27 | 0.62 | ○ |
| 5-19 | 0.42 | 0.25 | 0.20 | 2.00 | 0.16 | 0.13 | 2.20E−02 | 1.52E−02 | 0.33 | 0.50 | ○ |
| 5-20 | 0.42 | 0.30 | 0.20 | 2.00 | 0.16 | 0.13 | 2.64E−02 | 1.52E−02 | 0.38 | 0.42 | ○ |

As can be seen from Tables 1 to 5, when the value of the left part of the formula (12) is over 1, problems occur to water discharging performance. Also, it can be seen that water discharging performance can be calculated in advance by using the corresponding height $h_a'$ ($h_p'$) when the upper surface guide in which the distance between the pass line and the upper surface guide changes in the sheet passing direction (pass line direction) is used. By comparing the results in Tables 4 and 5 with the results in Table 3, it can be also seen that the water discharging performance improves as the cross-sectional area of virtual flow path is enlarged.

DESCRIPTION OF THE REFERENCE NUMERALS

1 steel sheet
10 manufacturing apparatus
11 row of rolling mills
11*g* final stand
11*gh* housing
11*gr* standing portion (of housing) (side wall)
12 transporting roll
13 pinch roll
20 cooling apparatus
21 upper surface water supplying device
21*a* cooling header
21*b* conduit
21*c* cooling nozzle
22 lower surface water supplying device
22*a* cooling header
22*b* conduit
22*c* cooling nozzle
30 upper surface guide
35 lower surface guide
P pass line

The invention claimed is:

1. A cooling apparatus disposed on a downstream side from a row of hot finish rolling mills, capable of supplying cooling water from above a pass line toward the pass line, the cooling apparatus comprising:

a plurality of cooling nozzles arranged parallel to a direction of the pass line; and an upper surface guide disposed between the pass line and the cooling nozzles, wherein each cooling nozzle of the plurality of cooling nozzles can spray cooling water with a cooling water volume density of 0.16 (m3/(m2·sec)) or more, and when the cooling water volume density of water to be sprayed is defined as qm (m3/(m2·sec)), a pitch of the cooling nozzle in a pass line direction is defined as L (m), a distance between a lower surface of the upper surface guide and the pass line is defined as hp (m), a uniform cooling width is defined as Wu (m), and a cross-sectional area of virtual flow path of discharging water flowing in a width direction of steel sheet per pitch of the cooling nozzle in the pass line direction is defined as S (m2), following relation is satisfied $$0.08 \cdot \frac{q_m \cdot W_u \cdot L}{S \cdot \sqrt{h_p}} \leqq 1$$

2. The cooling apparatus according to claim 1, wherein the upper surface guide has a configuration in which a distance between the pass line and the upper surface guide changes in the pass line direction; and a corresponding height hp' of the upper surface guide is applied instead of the distance hp.

3. The cooling apparatus according to claim 1, wherein at least either one of the upper surface guide or the cooling nozzle can move in top and bottom direction.

4. A manufacturing apparatus of a hot-rolled steel sheet comprising: a row of hot finish rolling mills; and the cooling apparatus according to claim 1 disposed on a downstream side from the row of hot finish rolling mills, wherein an end portion on upstream side of the cooling apparatus is disposed inside a final stand in the row of hot finish rolling mills.

5. A manufacturing method of a hot-rolled steel sheet comprising a step to supply cooling water to at least an upper surface of a steel sheet after final rolling to thereby cool the steel sheet using a cooling apparatus disposed on a downstream side from a row of hot finish rolling mills, wherein following relationship is satisfied when a volume density of cooling water from a cooling nozzle provided to the cooling apparatus is defined as qa (m3/(m2·sec)) that is 0.16(m3/(m2·sec)) or more, a pitch of the cooling nozzle in a sheet passing direction is defined as L (m), a distance between a lower surface of an upper surface guide provided to the cooling apparatus and an upper surface of the steel sheet to be passed is defined as ha (m), a width of the steel sheet to be passed is defined as Wa (m), and a cross-sectional area of virtual flow path of discharging water flowing in a width direction of steel sheet per pitch of the cooling nozzle in the sheet passing direction is defined as Sa (m2).

$$0.08 \cdot \frac{q_a \cdot W_a \cdot L}{S_a \cdot \sqrt{h_a}} \leqq 1$$

6. The manufacturing method of a hot-rolled steel sheet according to claim 5, wherein a corresponding height ha' of the upper surface guide is applied instead of the distance ha when the upper surface guide has a configuration in which a distance between the steel sheet and the upper surface guide changes in the sheet passing direction.

7. The manufacturing method of a hot-rolled steel sheet according to claim 5, wherein at least either one of the upper surface guide or the cooling nozzle can move in top and bottom direction.

8. The manufacturing method of a hot-rolled steel sheet according to claim 5, wherein an end portion on upstream side of the cooling apparatus is disposed inside a final stand in the row of hot finish rolling mills.

* * * * *